US007494415B2

(12) United States Patent
Nakajima

(10) Patent No.: US 7,494,415 B2
(45) Date of Patent: Feb. 24, 2009

(54) GAMING MACHINE

(75) Inventor: Yukako Nakajima, Tokyo (JP)

(73) Assignee: Aruze Corp., Tokyo (JP)

( * ) Notice: Subject to any disclaimer, the term of this patent is extended or adjusted under 35 U.S.C. 154(b) by 300 days.

(21) Appl. No.: 11/059,410

(22) Filed: Feb. 17, 2005

(65) Prior Publication Data

US 2005/0192073 A1 Sep. 1, 2005

(30) Foreign Application Priority Data

Feb. 17, 2004 (JP) ..... 2004-040537

(51) Int. Cl.
*A63F 3/00* (2006.01)
*A63F 9/24* (2006.01)

(52) U.S. Cl. ..... 463/20; 463/15; 463/16

(58) Field of Classification Search ..... 463/16–20
See application file for complete search history.

(56) References Cited

U.S. PATENT DOCUMENTS 4,871,171 A * 10/1989 Rivero ..... 463/20
5,106,091 A * 4/1992 Comito ..... 463/22
5,292,127 A * 3/1994 Kelly et al. ..... 273/118 A
5,393,057 A 2/1995 Marnell, II
5,655,965 A * 8/1997 Takemoto et al. ..... 463/20
5,722,891 A * 3/1998 Inoue ..... 463/20
5,788,573 A * 8/1998 Baerlocher et al. ..... 463/16
5,980,384 A 11/1999 Barrie
5,997,400 A * 12/1999 Seelig et al. ..... 463/6
6,290,600 B1 * 9/2001 Glasson ..... 463/20
6,315,660 B1 * 11/2001 DeMar et al. ..... 463/16
6,428,412 B1 8/2002 Anderson et al.
6,551,187 B1 * 4/2003 Jaffe ..... 463/20
6,592,457 B1 * 7/2003 Frohm et al. ..... 463/16
6,602,136 B1 * 8/2003 Baerlocher et al. ..... 463/16
6,652,378 B2 * 11/2003 Cannon et al. ..... 463/20
6,743,096 B2 * 6/2004 Allendorf et al. ..... 463/25
6,908,383 B2 * 6/2005 Baerlocher et al. ..... 463/20
6,988,947 B2 * 1/2006 Baerlocher et al. ..... 463/20
2002/0010018 A1 * 1/2002 Lemay et al. ..... 463/20

(Continued)

FOREIGN PATENT DOCUMENTS

EP 1 260 928 A2 11/2002

(Continued)

OTHER PUBLICATIONS

U.S. Appl. No. 11/047,821, filed Feb. 2, 2005, Nakajima.

(Continued)

*Primary Examiner*—Robert E Pezzuto
*Assistant Examiner*—Joshua P. Wert
(74) *Attorney, Agent, or Firm*—Oblon, Spivak, McClelland, Maier & Neustadt, P.C.

(57) ABSTRACT

A gaming machine includes symbol display unit 4 for variably displaying a plurality of symbols, game element acquisition unit 2 for selecting a symbol displayed on the symbol display unit 4 and acquiring a game element based on the selected symbol, game processing unit 3 for performing game processing for players to compete with each other for a move of a piece based on the game element acquired in the game element acquisition unit 2, and game display unit 5 for displaying the processing result of the game processing unit 3.

20 Claims, 18 Drawing Sheets

U.S. PATENT DOCUMENTS

| | | | | |
|---|---|---|---|---|
| 2002/0016200 | A1* | 2/2002 | Baerlocher et al. | 463/20 |
| 2003/0119581 | A1 | 6/2003 | Cannon et al. | |
| 2003/0130028 | A1* | 7/2003 | Aida et al. | 463/20 |
| 2003/0224851 | A1 | 12/2003 | Gilmore | |
| 2005/0003886 | A1* | 1/2005 | Englman et al. | 463/25 |
| 2005/0187008 | A1* | 8/2005 | Nakajima | 463/20 |

FOREIGN PATENT DOCUMENTS

| | | |
|---|---|---|
| GB | 2 372 617 A | 8/2002 |
| JP | 60-37381 | 3/1985 |
| JP | 61-113488 | 5/1986 |
| JP | 5-9117 | 2/1993 |
| JP | 11-253610 | 9/1999 |
| JP | 11-290505 | 10/1999 |
| JP | 2001-252394 | 9/2001 |
| JP | 2002-248201 | 9/2002 |
| JP | 2004-16264 | 1/2004 |
| WO | WO 03/046850 A2 | 6/2003 |

OTHER PUBLICATIONS

U.S. Appl. No. 11/059,410, filed Feb. 17, 2005, Nakajima.

"'93 Year Book", Amusement Industry Publishing Corp., Aug. 26, 1993, 4 pages.

Hudson Official Guidebook, Super MOMOTARO Electric Railway DX, Shogakukan Inc., May 10, 1996, First Edition, Third Printing, pp. 64, 70, 81.

* cited by examiner

FIG. 4A

TWO PLAYERS

| | | |
|---|---|---|
| ○ | 1 | ADVANCE |
| ○ | 2 | RETURN |
| ○ | 3 | ADVANCE |
| ○ | 4 | RETURN |
| ● | 5 | ADVANCE |
| 7 | 7 | 7 |
| ○ | 1 | RETURN |
| ○ | 2 | ADVANCE |
| ○ | 3 | RETURN |
| ○ | 4 | ADVANCE |
| ● | 5 | RETURN |
| 7 | 7 | 7 |

FIG. 4B

| | | |
|---|---|---|
| ○ | 1 | ADVANCE |

FIG. 4C

| | | |
|---|---|---|
| ● | 3 | RETURN |

FIG. 4D

| | | |
|---|---|---|
| 7 | 7 | 7 |

FIG. 4E

FOUR PLAYERS

| | | |
|---|---|---|
| A | 1 | ADVANCE |
| A | 2 | RETURN |
| A | 3 | ADVANCE |
| A | 4 | RETURN |
| B | 5 | ADVANCE |
| 7 | 7 | 7 |
| A | 1 | RETURN |
| A | 2 | ADVANCE |
| A | 3 | RETURN |
| C | 4 | ADVANCE |
| D | 5 | RETURN |
| 7 | 7 | 7 |

FIG. 4F

| | | |
|---|---|---|
| A | 1 | ADVANCE |

FIG. 4G

| | | |
|---|---|---|
| B | 5 | RETURN |

FIG. 4H

| | | |
|---|---|---|
| 7 | 7 | 7 |

FIG. 6A
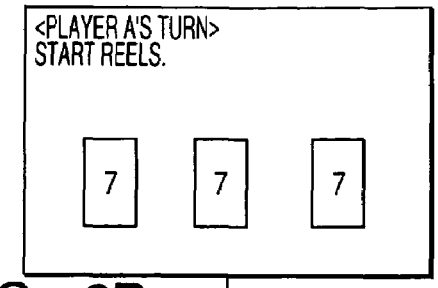
FIG. 6B
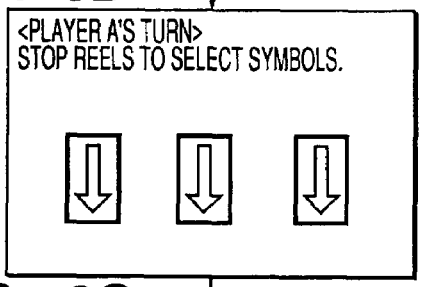
FIG. 6C
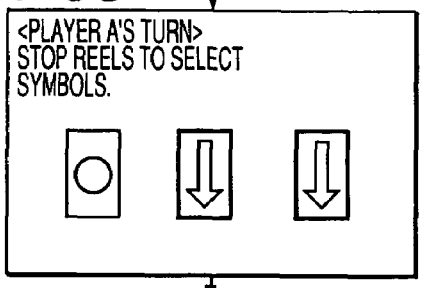
FIG. 6D
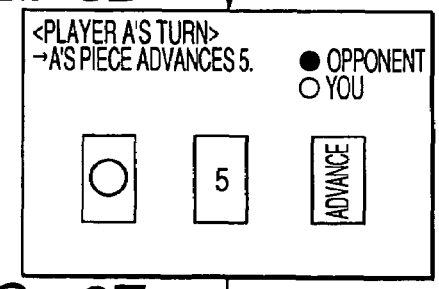
FIG. 6E
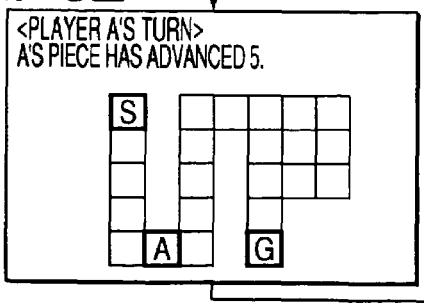
FIG. 6F
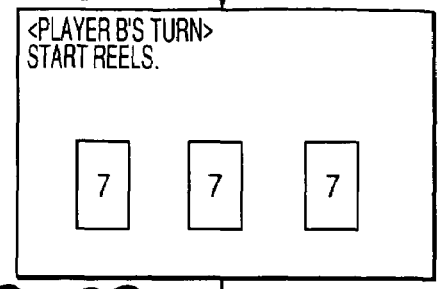
FIG. 6G
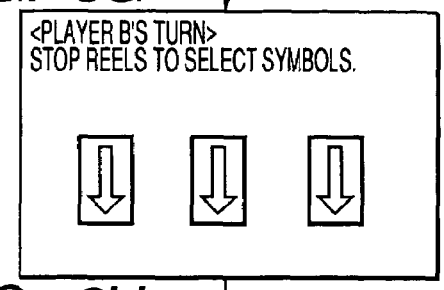
FIG. 6H
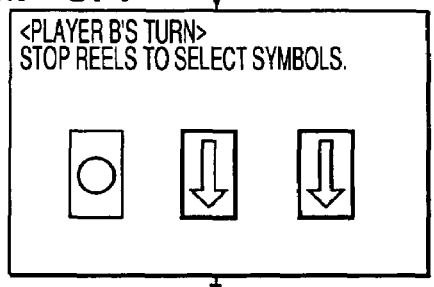
FIG. 6I
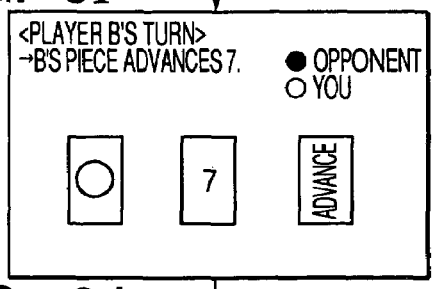
FIG. 6J
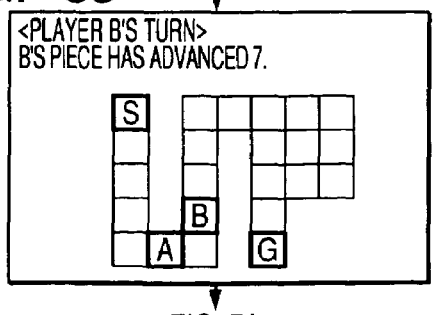
FIG. 7A FIG. 7A
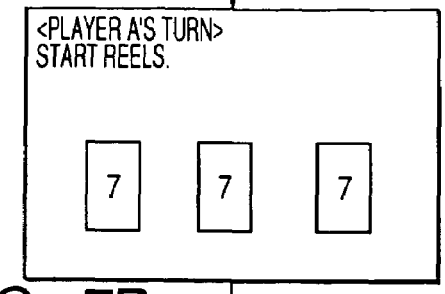
FIG. 7B
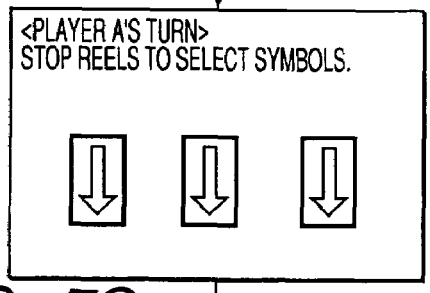
FIG. 7C
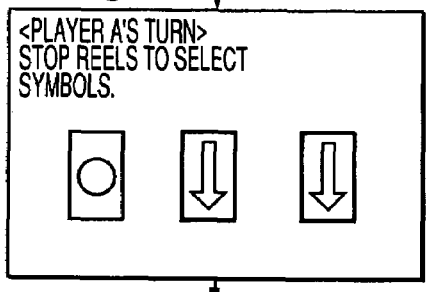
FIG. 7D
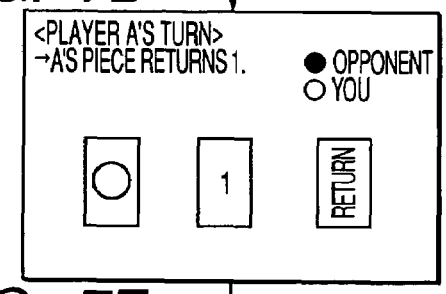
FIG. 7E
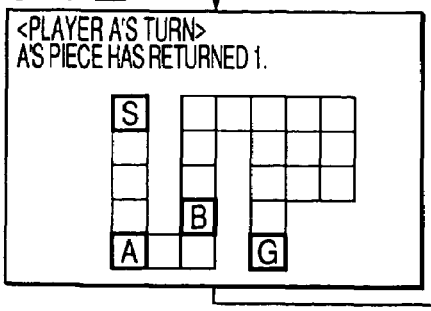
FIG. 7F
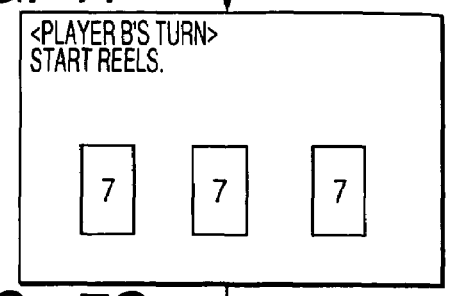
FIG. 7G
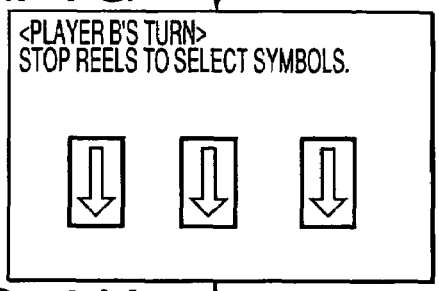
FIG. 7H
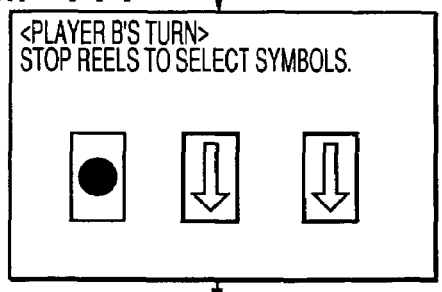
FIG. 7I
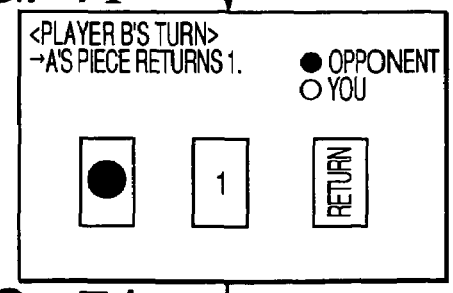
FIG. 7J
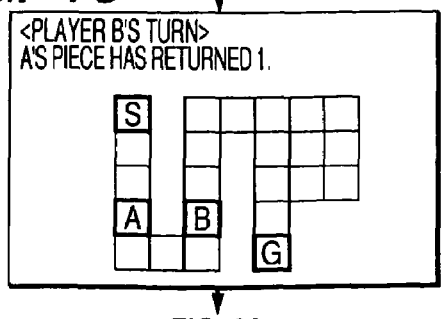
FIG. 8A

GAMING MACHINE

CROSS-REFERENCE TO THE RELATED APPLICATION(S)

The application is based upon and claims a priority from prior Japanese Patent Application No. 2004-040537 filed on Feb. 17, 2004, the entire contents of which are incorporated herein by reference. The application is related to co-pending U.S. application claiming priority on Japanese Patent Application No. 2004-025757. The co-pending application is expressly incorporated herein by reference.

BACKGROUND OF THE INVENTION

1. Field of the Invention

The present invention relates to a gaming machine and a gaming program.

2. Description of the Related Art

A gaming machine for variably displaying symbol rows each with a plurality of symbols placed thereon, stopping the variation according to operation of the player, and competing with the player based on the displayed symbol combination is known as a slot gaming machine, for example.

For example, in a general slot machine, three reels are placed side by side at the rear of a front panel and various symbols are drawn on the surface of each reel. The symbols can be observed through a window. The reels are provided with a drive mechanism and the player starts to rotate each reel by operating a start lever. As the reels are rotated, rotation move display of the symbols on each row is produced on the window. The player presses a stop button while observing the moving symbols, thereby stopping rotation of each reel. The symbols responsive to the operation timing of the stop button are displayed on each reel. A plurality of pay lines are provided on the window and when a predetermined combination of the symbols is displayed on any pay line, the player wins the game in response to the combination of the symbols. The player competes with the gaming machine for the timing of pressing the stop button so as to display a predetermined combination of the symbols on any pay line.

Generally, the winning state includes a big bonus, a medium bonus, a small bonus, etc., and the player can win any of the prizes according to the symbol combination on the pay line. Before the stop button is pressed, the winning state is already determined by random number lottery (internal lottery) at the start lever operation time, and the player can win the game (prize) by stopping the winning symbol combination determined by the lottery on the pay line.

There is proposed a slot machine for playing a game such as cards using reels. The slot machine includes five reels rather than usual three reels and symbols of cards are arranged on the reels for the player to play poker according to the symbols of the cards stopped on a pay line. The slot machine involves the following problem: Since the number of the symbols that can be distributed to the reels is limited, the display mode of the displayed cards is limited.

In order to solve the above problem, a slot machine is proposed wherein reels are separated into a reel on which integers of 1 to 13 are arranged and a reel on which card suits (spade, heart, club, and diamond) are arranged and the card symbols are represented using numerals and suits in combination, whereby a usual poker state is reproduced on the machine. (For example, refer to JP-A-2002-248201.)

SUMMARY OF THE INVENTION

The above-described slot machine is intended for providing a poker game on the slot machine and the reels of the slot machine are used only as Display unit for displaying the card symbols. Thus, the games that can be applied to the slot machine are limited to those wherein a win or a loss is determined only according to the combination of the symbols displayed on the reels when the reels stop.

Thus, the games are limited to simple games such as poker as the game is over by one reel operation. Since a win or a loss is determined only according to one symbol combination, the slot machine can be applied to a single-player game played by one player, but is not suited for a game played by two or more players.

Therefore, a gaming machine using a symbol combination like a gaming machine using reels of a slot machine in the related art involves a problem of a narrow game application range in the types of games, the number of players entering a game, etc.

It is therefore one of objects of the invention to widen the application range in the game types, the number of players entering a game, etc., in a gaming machine using a symbol combination. It is another object of the invention to provide a gaming machine with competition and strategy properties for improving interest by more than one operation and game element combination obtained by each operation.

According to a first aspect of the invention, there is provided a gaming machine including: a symbol display unit that variably displays a plurality of symbols arranged on a reel; a game element acquisition unit that selects a symbol displayed on the symbol display unit and acquires a game element based on the selected symbol; a game processing unit that performs game processing for players to compete with each other for a move of a piece based on the game element acquired in the game element acquisition unit; and a game display unit that displays the processing result of the game processing unit.

According to a second aspect of the invention, there is provided a computer-readable program product for causing a computer to execute: displaying a varying state and a stop state of a plurality of symbols; varying the symbols and acquiring a game element from the symbol at a stop position; reading a piece position currently stored in a piece position storage unit; determining a move amount of the piece position from the acquired game element; determining a new piece position with respect to the piece position read from the piece position in accordance with the determined move amount; updating the new piece position as the current piece position to store in the piece position storage unit; determining a comparison between the piece position and a predetermined position.

According to a third aspect of the invention, there is provided an automatic game performing method executed in a computer including the steps of: displaying a varying state and a stop state of a plurality of symbols; varying the symbols and acquiring a game element from the symbol at a stop position; reading a piece position currently stored in a piece position storage unit; determining a move amount of the piece position from the acquired game element; determining a new piece position with respect to the piece position read from the piece position in accordance with the determined move amount; updating the new piece position as the current piece position to store in the piece position storage unit; determining a comparison between the piece position and a predetermined position.

BRIEF DESCRIPTION OF THE DRAWINGS

These and other objects and advantages of the present invention will be more fully apparent from the following detailed description taken in conjunction with the accompanying drawings, in which:

FIGS. 4A to 4H are drawings to show examples of symbol rows of reels of the invention;

FIGS. 6A to 6J show a display example to describe the operation example of the gaming machine of the invention;

FIGS. 7A to 7J show a display example to describe the operation example of the gaming machine of the invention;

DETAILED DESCRIPTION OF THE PREFERRED EMBODIMENTS

Referring now to the accompanying drawings, there are shown preferred embodiments of the invention.

Figure 1:
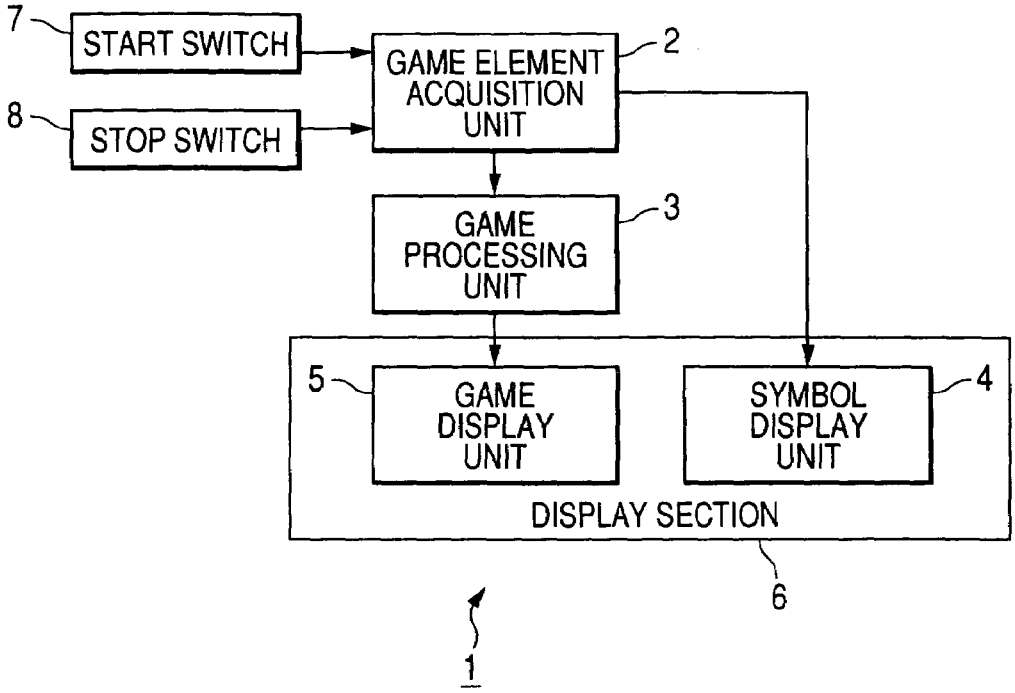
FIG. 1 is a schematic block diagram to describe the configuration of a gaming machine of the invention.

FIG. 1 is a schematic block diagram to describe the configuration of a gaming machine of the invention. A gaming machine 1 includes a symbol display unit 4 for variably displaying a plurality of symbols, a game element acquisition unit 2 for selecting symbols displayed on the symbol display unit 4 and an acquiring game elements based on the selected symbols, a game processing unit 3 for performing game processing for the players to compete with each other for a move of a piece based on the game elements acquired by the game element acquisition unit 2, and a game display unit 5 for displaying the processing result of the game processing unit 3.

The game element acquisition unit 2 includes a selection function of selecting the symbols displayed on the symbol display unit 4 and a game element acquisition function of acquiring the game elements based on the selected symbols. The game element acquisition unit 2 includes a plurality of reels each with a symbol row made up of a plurality of symbols displayed on the surface of the reel, for example, and rotates the reels separately and stops the reels at the timing selected by the player, thereby selecting the symbols. The selected symbols are displayed on the symbol display unit 4.

Each of the reels is provided with a symbol row and the reels are stopped separately, whereby variously combined symbols can be selected. As the symbols, any of digits, characters, patterns, etc., can be set as desired.

The player starts to rotate each reel by operating a start switch 7 such as a start lever, for example. Rotation of the reels can be started all at once or can be started separately by operating the start switch 7. The player stops rotating the reels by operating a stop switch 8. The reels can be stopped separately by operating each of the stop switches provided in a one-to-one correspondence with the reels.

The player starts rotating the reels which initially stop by operating the start switch 7 and after predetermined speed is reached, the player operates the stop switch 8 to stop rotating each of the reels. As the reels are stopped, the selected symbols are displayed on the symbol display unit 4. The symbols preceding and following the selected symbols may be displayed.

At the time, the player operates the stop switches 8 timely so as to display desired symbols while observing the symbol display on the rotating reels. As the player operates the stop switches 8 for the reels, symbol combinations are selected. The selected symbol combinations are displayed on the symbol display unit 4.

The game element acquisition unit 2 acquires game elements based on the selected symbols. The game elements make up a game and are used in advancing the game and are determined in response to the rule of the game. For example, to advance the game by moving a piece on a game board, in addition to motion as to what position on the game board and how the piece is to be moved to, options of the playing order of the players operating the piece, route change, and the like are determined by the game elements, whereby the game is played.

The game element acquisition unit 2 determines the game elements based on the selected symbol combination. For example, the position of the piece moved on the route, the move amount of the piece containing the move direction, or option selection determined for each game is determined according to the symbols and the symbol combination. The option selection includes play order change, route change, etc., for example. The game processing unit 3 performs game processing based on the game rule using the game elements acquired by the game element acquisition unit 2, and determines a win or a loss of the game.

In the gaming machine using the slot machine in the related art, a win or a loss of the game is determined according to the selected symbol combination; while, the game element acquisition unit 2 of the gaming machine of the invention determines the game elements according to the selected symbol combination and the game processing unit 3 performs game processing using the game elements and determines a win or a loss of the game.

The difference between use of only the selected symbols and use of the game elements determined from the selected symbols appears not only in the game processing mode as described above, but also in the display mode.

The gaming machine 1 of the invention includes symbol display unit 4 and game display unit 5 as a display section 6 and displays the symbols selected by the game element acquisition unit 2 on the symbol display unit 4 and displays the game processing result of the game processing unit 3 using the game elements determined from the selected symbols on the game display unit 5. The player can adjust the timing of pressing the stop switch 8 so as to display selected symbols by observing the symbol display unit 4. The player can also examine the gate state determined by the game elements and work out a game strategy, etc., by observing the game display unit 5.

In contrast, in the gaming machine using the slot machine in the related art, symbol display and game display are in one piece and there is no room to incorporate the game elements as in the invention and the game ability and the competition ability cannot be provided.

Figure 2:
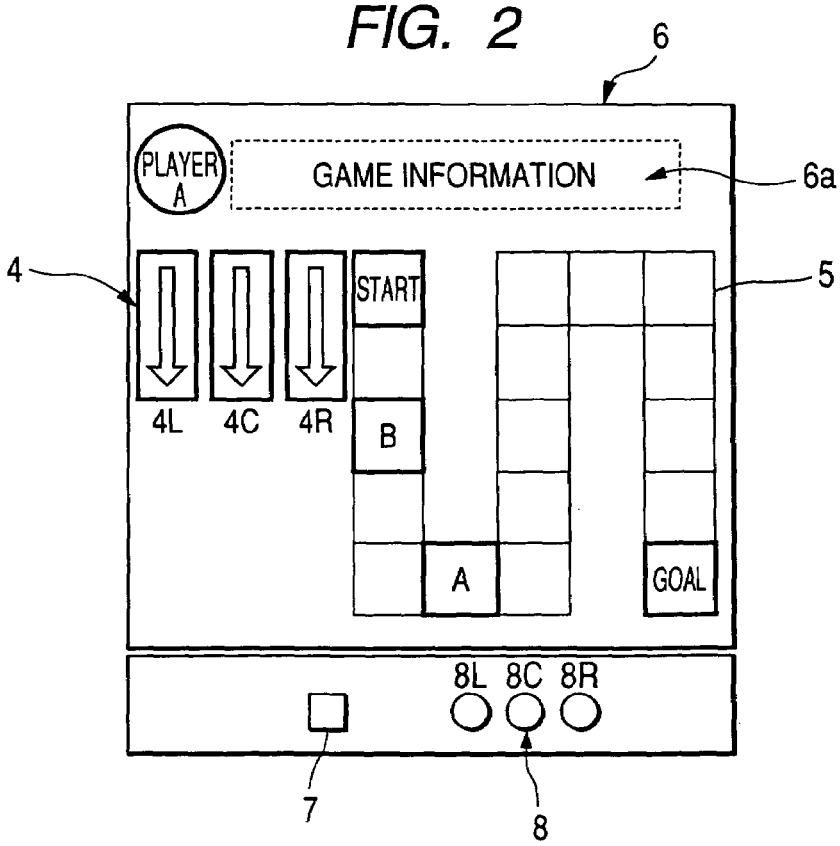
FIG. 2 is a drawing to describe an example of a display section of the invention.

FIGS. 2 and 3 are drawings to describe examples of the display section. FIG. 2 shows a configuration example of the display section wherein the symbol display unit 4 and the game display unit 5 are placed side by side on the same liquid crystal display.

The symbol display unit 4 electrically displays reels 4R, 4C, and 4L representing the reels of a slot machine on the liquid crystal display. The number of the reels is not limited to three and any number of the reels can be set in response to the game elements. Each reel of the symbol display unit 4 is circulated as a symbol row made up of a plurality of rows is rotated in order; as the start switch 7 is operated, rotation is started and as the stop switch 8 is operated, rotation is stopped.

Here, rotation of all reels is started as the player operates the start switch 7. In the rotation display, operation display of moving the symbol rows is produced. In FIG. 2, the operation display is indicated by arrows. Rotation of all reels may be started not only simultaneously, but also separately. Rotation of the reels 4R, 4C, and 4L is stopped separately as the player operates stop switches 8R, 8C, and 8L, and the symbols selected at the stop time are displayed as still symbols. The stop switches 8 (8R, 8C, and 8L) are provided in a one-to-one correspondence with the reels (4R, 4C, and 4L) of the symbol display unit 4; alternatively the reels may be stopped in order by operating one stop switch.

In the gaming machine 1 according to the embodiment, the reels 4R, 4C, 4L variably displayed by the symbol display unit 4 stop when the stop switch 8 is operated by the player.

However, it is possible to configure the gaming machine 1 to automatically stop the reels 4R, 4C, 4L that are variably displayed based on a control by the game element acquisition unit 2 or the game processing unit 3 (or by the CPU 11 in the embodiments which will be described later). According to this configuration, there is no need to provide the stop switch 8 and the structural configuration of the gaming machine 1 can be simplified. Moreover, due to the simplification of the game progress by eliminating the stop switch 8, the player can easily acquaint himself to the game. In a case where this configuration is applied, the process to determine that whether or not the selected symbol combination is a symbol combination whose use is improper in the game processing (the process of step S6 shown in FIG. 5) may be included in the process to perform an inner lottery to determine the winning state (the process included in the process of step S5 shown in FIG. 5).

The game display unit 5 is a portion for producing liquid crystal display of the game state. The game display unit 5 shown in FIG. 2 produces liquid crystal display of a route with sugoroku, a Japanese variety of parchisi (backgammon, board game), taken as an example. In a sugoroku game for the players to compete with each other for arrival at the goal by moving a piece along a route, the piece of each player is displayed at each position set on the route, whereby the progress of the piece of each player is represented. In the display example shown in FIG. 2, placement parts of a plurality of pieces starting at the start point and ending with the end point form a route and the piece of each player is displayed in each part, whereby the progress of the piece of each player is represented. In FIG. 2, the pieces of players A and B are represented by marks A and B respectively.

In the game performed in the gaming machine 1, the route is formed by box-shaped areas (described later) adjacent with each other, and the pieces of each of the player is moved along the route, area by area.

The route shown on the game display unit 5 in FIG. 2 is by way of example, and the shape of the route can be set as desired. In the example in FIG. 2, a game information section 6*a* for displaying game information representing the description and the progress state of the game can also be provided in addition to the symbol display unit 4 and the game display unit 5.

The configuration of the game display unit described above enables the player to observe the display content produced by the symbol display unit 4 and that produced by the game display unit 5 on one liquid crystal display.

Figure 3A:
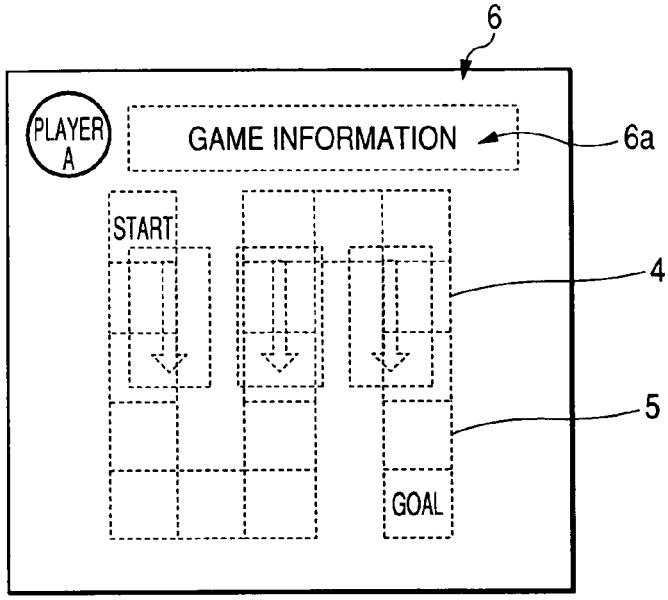
FIGS. 3A to 3C are drawings to describe another example of the display section of the invention.
Figure 3B:
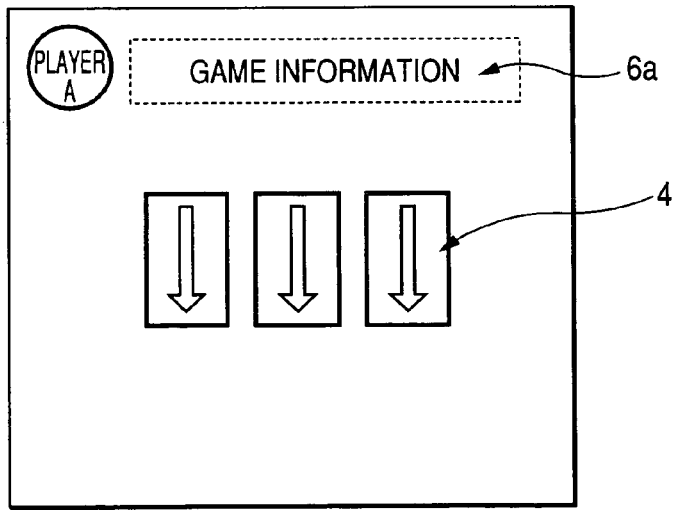
Figure 3C:
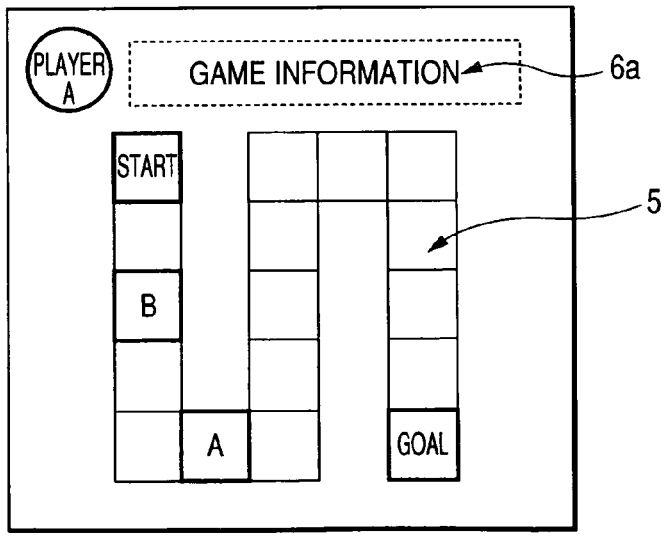

The display section shown in FIGS. 3A to 3C has the symbol display unit 4 for producing rotation display of mechanical reels and the game display unit 5 for producing liquid crystal display as layers; the mechanical reels of the symbol display unit 4 are provided at the rear of the screen of the liquid crystal display of the game display unit 5 so that the mechanical reels can be rotated and stopped.

The liquid crystal display has a liquid crystal material sandwiched between transparent glass substrates for producing the display content by controlling the voltage applied to the substrate, and can also be placed in a transparent state. As the screen of the liquid crystal display is placed in the transparent state, the mechanical reels provided at the rear of the screen of the liquid crystal display can be observed through the transparent glass substrates.

FIG. 3A shows the symbol display unit 4 and the game display unit 5 superposed on each other. FIG. 3B shows a state in which the screen of the liquid crystal display of the game display unit 5 is placed in the transparent state for displaying the symbol display unit 4 of the mechanical reels provided at the rear of the screen of the liquid crystal display. FIG. 3C shows a display state of producing game display on the screen of the liquid crystal display of the game display unit 5.

According to the state in FIG. 3B, the player can observe rotation display of the mechanical reels and the symbols in the stop state of the mechanical reels through the transparent glass substrates of the game display unit 5.

Symbol display of the mechanical reels and game display of the liquid crystal display can also be produced at the same time by controlling the liquid crystal display screen of the game display unit 5.

FIGS. 4A to 4H are drawings to show examples of the symbol rows of the reels. FIGS. 4A to 4D show an example of the symbol rows in the case where the number of players is up to two, and FIGS. 4E to 4H show an example of the symbol rows in the case where the number of players is up to four. In both examples, the case where the number of the reels is three is shown, but the number of the reels is not limited to three and any number of the reels can be set in response to the game.

In the embodiment, it is assumed that a plurality of players play the game and compete with each other. The plurality of players may include one or more computer character in which the operation thereof is automatically processed. The operation (game play) by the computer character is achieved as such by the game processing unit 3 being progressing the game in accordance with a software program. According to this configuration, the game may be played by a single player as such by playing against the computer character. Moreover, in a case where more than one players plays the game, the game progress becomes more unpredictable by including one or more computer character, thereby the entertainment of the game can be improved. When the computer character is included as a player, one of the circle marks that represent the players (the circle marks as shown in FIG. 4A) may be allocated to the computer character.

One of the three reels shown in FIG. 4A is provided with a symbol row made up of marks of white circle and black circle, another reel is provided with a symbol row made up of digits of 1 to 7, and still another reel is provided with a symbol row made up of indications determining the piece traveling directions. In the example in FIG. 4A, two types of indications of "forward" meaning the direction moving the piece forward and "backward" meaning the direction moving the piece backward are shown.

The game elements can be determined according to the combination of the symbols. FIGS. 4B to 4D show examples of the game elements based on the combinations of the symbols. For example, in FIG. 4B, the position of the piece of the game element on the route is determined by the combination of the symbol of the "white circle" mark, the symbol of the digit of "1," and the symbol of "forward." Here, "white circle" represents the current playing player and the digit of "1" and the indication of "forward" mean that the piece is moved forward by "1" on the route.

In FIG. 4C, the position of the piece of the game element on the route is determined by the combination of the symbol of the "black circle" mark, the symbol of the digit of "3," and the symbol of "backward." Here, "black circle" represents the opponent of the current playing player and the digit of "3" and the indication of "backward" mean that the piece is moved backward by "3" on the route.

A common symbol to the reels is provided and when all are complete, some game element can also be assigned. For example, a digit of "7" is provided in each reel and when the symbols of the digit of "7" are complete on all reels as in FIG. 4D, an option set for each game is determined. The options include play order change, route change, etc., for example, and the description of each option can be set as desired for each game. The setup item set by each option may be a previously setup item or may be selected by the player through the input unit. For example, in the route change option, the route may be changed to the preset route or route change may be set by the player through the input unit.

FIGS. 4E to 4H show examples of the symbol rows applied when up to four players play a game. One of the three reels shown in FIG. 4E is provided with a symbol row made up of letters "A," "B," "C," and "D," another reel is provided with a symbol row made up of digits of 1 to 7, and still another reel is provided with a symbol row made up of two types of indications of "forward" meaning the direction moving the piece forward and "backward" meaning the direction moving the piece backward are shown. For example, a digit of "7" is displayed common to all reels.

Here, the letters "A," "B," "C," and "D" represent four players and a combination of the digits "1" to "7" and the indications "forward" and "backward" represents the piece move amount containing the move direction as in the example in FIGS. 4A to 4D.

For example, in FIG. 4F, the position of the piece of the game element on the route is determined by the combination of the symbol of the letter "A," the symbol of the digit of "1," and the symbol of "forward" and player A's piece moves forward (advances) by "1" on the route.

For example, in FIG. 4G, the position of the piece of the game element on the route is determined by the combination of the symbol of the letter "B," the symbol of the digit of "5," and the symbol of "backward" and player B moves backward "5" on the route.

FIG. 4H represents a combination in which all symbols are the digits "7" and the option set for each game is determined as in the example in FIG. 4D.

The reels shown in FIGS. 4A to 4H are by way of example, and the number of the reels, the number, the types, the placement order, etc., of the symbols provided on the surface of one reel can be set as desired. Although the diameter and the rotation speed of each reel can also be determined as desired, all reels are set to the same reel diameter, the same number of symbols, and the same rotation speed, whereby they can be set to the same symbol move speed when the player observes the symbols on the reels.

A diameter of the reel, the number of symbols, and the rotation speed are changed for each reel, whereby each reel can be set to different symbol move speed when the player observes the symbols on the reels.

In order to display the symbols with electric reels of liquid crystal, etc., the diameter of the reel, the rotation speed, etc., can be changed by adjusting the change speed of a movably displayed image.

Figure 5:
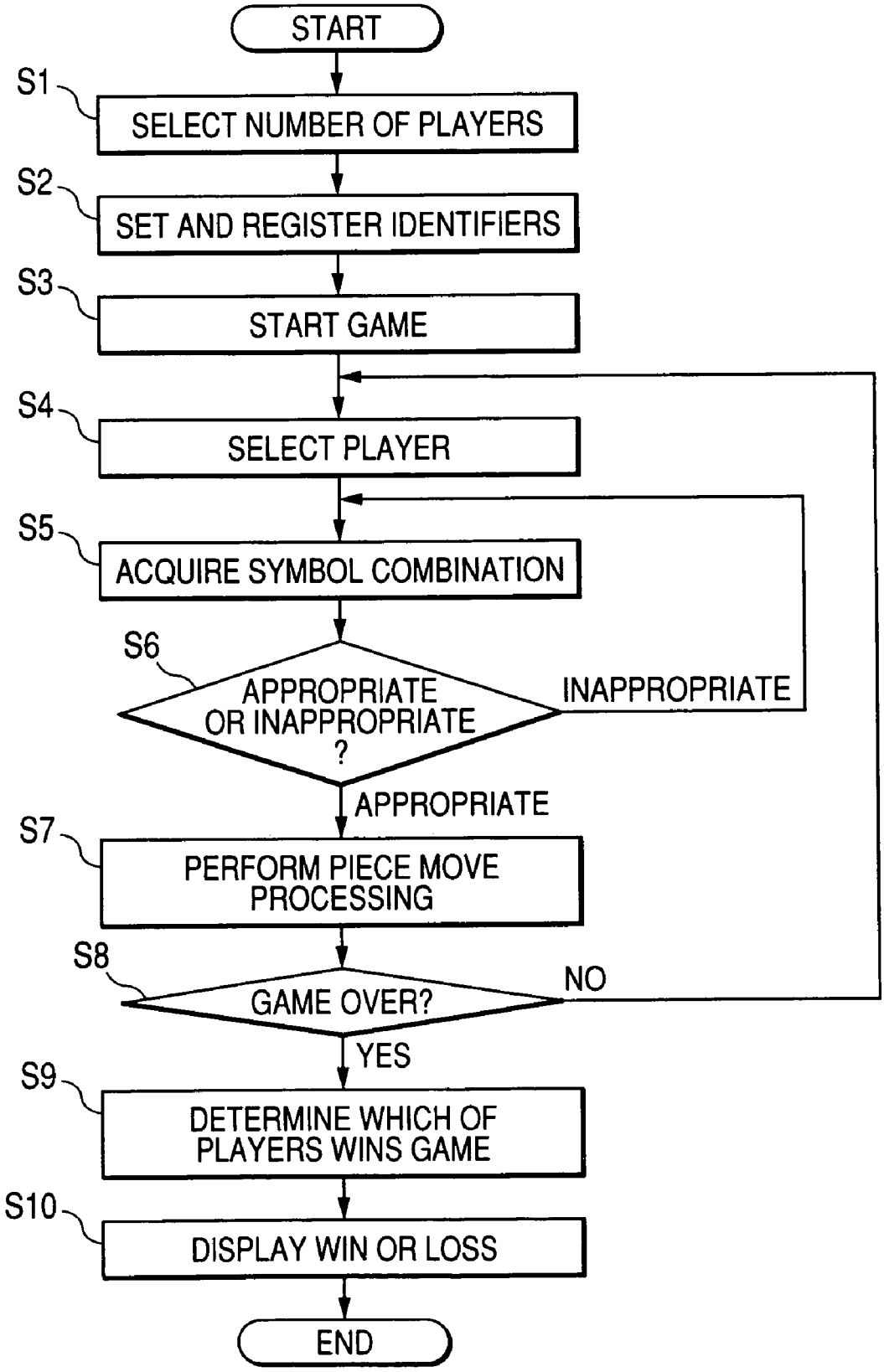
FIG. 5 is a flowchart to describe an operation example of the gaming machine of the invention.

Next, an operation example of the gaming machine of the invention will be discussed with a flowchart of FIG. 5 and display examples in FIGS. 6A to 8I. In the description to follow, a sugoroku game for players to compete with each other for arrival of each player's piece to a predetermined position or the number of points (score) acquired in moving by moving each piece along a route is taken as a game example.

To start a game, the number of players is selected (step S1) and the identifiers of names, nicknames, etc., of the player are set if necessary. Although the identifiers may be set or may not be set in the gaming machine as the players desire, if the identifiers are set, they can be displayed on the game display surface (step S2).

After a game is started (step S3), the player playing the game is selected. To select the player, the play order can be predetermined and the players can play the game in the predetermined play order (step S4).

The selected player operates the start switch to start reel rotation and then operates the stop switches to stop the rotationally displayed reels. Operating the stop switches is controlled so that the stop switches cannot work until the reel rotation speed exceeds predetermined speed, whereby ease of the stop operation at low rotation speed time can be eliminated.

When the player operates the stop switches, the displayed symbols standing still at the operation point in time are determined on the reels, whereby the symbol combination is also determined and the game elements are also determined accordingly. The game element acquisition unit acquires the game elements involved in the symbol combination (step S5).

Whether or not the symbol combination determined as the player operates the stop switches is appropriate is determined. If the symbol combination is inappropriate, a symbol combination is again acquired at step S5. The inappropriate symbol combination applies, for example, if the use of the symbol combination is improper in the game processing. To determine whether or not the symbol combination is appropriate, whether or not the selected symbol combination is a symbol combination whose use is improper in the game processing is determined (step S6).

If the selected symbol combination is appropriate, the piece is moved based on the game element corresponding to the symbol combination.

At this time, whether or not the symbol combination is a specific symbol combination is determined and the setup option is executed. For example, if play order change or route change is set as an option for the symbol combination defining a specific game element such as "7 7 7" shown in FIG. 4, the player order is changed for the same player to repeat more than once piece move operation by selecting symbols or a new route is added to the original route or a route is deleted. Where the route to be added or the route to be deleted is may be previously determined or may be set by the player through the input unit.

On the other hand, if the symbol combination is not a specific symbol combination, game processing is performed based on the game elements responsive to the symbol combination, and the player's piece or the opponent's piece is placed in a predetermined position on the route (step S7).

As the piece move processing is performed at step S7, the piece position of the player on the route changes. Whether or not the piece position is a predetermined position, such as the goal position, is determined for determining whether or not the game is substantially over.

The game over determination criterion can be set as desired. For example, the fact that one player or a predetermined number of players arrive at the goal can also be adopted as the game over determination criterion or the number of processing times of symbol selection, the game time, etc., can also be adopted as the game over determination criterion (step S8).

If the game is not over (NO at step S8), the process returns to step S4 and steps S5 to S7 are repeated according to the next player.

On the other hand, if the game is over (YES at step S8), which of the players wins the game is determined. The determination criterion for determining which of the players wins the game can be set as desired. For example, the first player arriving at the goal at step S8 can be determined a winner or the number of points (score) acquired during moving on the route by each of the players arriving at the goal can also be adopted as the determination criterion for determining which of the players wins the game (step S9). The game result (win or loss) is displayed on the game display unit (step S10).

Symbol combination selection operation and piece move processing will be discussed with FIGS. 6 to 8. Here, the case where two players of players A and B play a game is shown.

When it is the turn of the player A to play the game, the stop reels are displayed on the symbol display unit and a message of "Player A's turn," "Start reels" is displayed (FIG. 6A). The player A operates the start switch in response to the message, whereby the reels start to rotate. The rotating reels are displayed on the symbol display unit and a message of "Player A's turn," "Stop reels to select symbols" is displayed (FIG. 6B). Whenever the player operates the stop switch, the reel rotation stops and the symbols are displayed standing still on each reel. FIG. 6C shows a state in which the left reel in the figure stops and a symbol of "white circle" is displayed thereon.

When the player stops all reels, the stopped reels are displayed on the symbol display unit. A message of "Player A's turn," "A's piece advances 5" is displayed. Here, "white circle" "5" "forward" is displayed on the symbol display unit. "white circle" represents the player, "5" represents the piece advance amount on the route, and "forward" represents the piece advance direction on the route. The piece advance amount is a relative amount and is the move amount from the previous piece position (FIG. 6D).

As the symbol combination is selected, the piece position of the game element on the route is determined. The state of the determined piece position is displayed on the game display unit and a message of "Player A's turn," "Player A's piece has advanced 2" is displayed. In FIG. 6E, the letter "A" is displayed on the route, whereby the position of the player A is indicated.

Next, the player's turn is changed from player A to player B. In the play turn of the player B, the stop reels are displayed on the symbol display unit and a message of "Player B's turn," "Start reels" is displayed (FIG. 6F). The player B operates the start switch in response to the message, whereby the reels start to rotate. The rotating reels are displayed on the symbol display unit and a message of "Player B's turn," "Stop reels to select symbols" is displayed (FIG. 6G). Whenever the player operates the stop switch, the reel rotation stops and the symbols are displayed standing still on each reel. FIG. 6H shows a state in which the left reel in the figure stops and a symbol of "white circle" is displayed thereon.

When the player stops all reels, the stopped reels are displayed on the symbol display unit and a message of "Player B's turn," "B's piece advances 7" is displayed. Here, "white circle" "7" "forward" is displayed on the symbol display unit. "white circle" represents the player, "7" represents the piece advance amount on the route, and "forward" represents the piece advance direction on the route. The piece advance amount is a relative amount and is the move amount from the previous piece position (FIG. 6I).

As the symbol combination is selected, the piece position of the game element on the route is determined. The state of the determined piece position is displayed on the game display unit and a message of "Player B's turn," "Player B's piece has advanced 7" is displayed. In FIG. 6J, the letter "A" is displayed on the route and the letter "B" is also displayed, whereby the positions of the players A and B are indicated.

In the gaming machine 1, there may be configured that when the player's piece, during the movement along the route, encounters a branch point where more than one route to forward the piece is selectable, allows the player to select a route to forward the piece beyond the branch point. In configuring as above, the gaming machine 1 may be configured to allow the player input the selection by use of the start switch 7 and the stop switch 8 with a user interface displayed on the display section 6. The gaming machine 1 may be configured by further providing an input device (such as an input button or a touch panel) for allowing the player input the selection.

In the gaming machine 1, there may alternatively be configured that when the player's piece encounters the branch point during the movement along the route, the route to forward the piece beyond the branch point is automatically selected by the game processing unit 3.

Next, the player's turn is changed again from player B to player A. In the play turn of the player A, the stop reels are displayed on the symbol display unit and a message of "Player A's turn," "Start reels" is displayed (FIG. 7A). The player A operates the start switch in response to the message, whereby the reels start to rotate. The rotating reels are displayed on the symbol display unit and a message of "Player A's turn," "Stop reels to select symbols" is displayed (FIG. 7B). Whenever the player operates the stop switch, the reel rotation stops and the symbols are displayed standing still on each reel. FIG. 7C shows a state in which the left reel in the figure stops and a symbol of "white circle" is displayed thereon.

When the player stops all reels, the stopped reels are displayed on the symbol display unit and a message of "Player A's turn," "Player A's piece moves backward for 1" is displayed. Here, "white circle" "1 "backward" is displayed on the symbol display unit. "White circle" represents the player, "1" represents the piece advance amount on the route, and "backward" means that the piece moves backward (returns) on the route. The piece advance amount is a relative amount and is the move amount from the previous piece position (FIG. 7D).

As the symbol combination is selected, the piece position of the game element on the route is determined. The state of the determined piece position is displayed on the game display unit and a message of "Player A's turn," "Player A's piece has returned 1" is displayed. In FIG. 7E, the letter "A" is displayed at the position returned by "1" from the previous position on the route, whereby the position of the player A is indicated.

Next, the player's turn is changed from player A to player B. In the play turn of the player B, the stop reels are displayed on the symbol display unit and a message of "Player B's turn," "Start reels" is displayed (FIG. 7F). The player B operates the start switch in response to the message, whereby the reels start to rotate. The rotating reels are displayed on the symbol display unit and a message of "Player B's turn," "Stop reels to select symbols" is displayed (FIG. 7G). Whenever the player operates the stop switch, the reel rotation stops and the symbols are displayed standing still on each reel. FIG. 7H shows a state in which the left reel in the figure stops and a symbol of "black circle" is displayed thereon.

When the player stops all reels, the stopped reels are displayed on the symbol display unit and a message of "Player B's turn," "Player A's piece returns 1" is displayed. Here, "black circle" "1" "backward" is displayed on the symbol display unit. "Black circle" represents the opponent, "1" represents the piece advance amount on the route, and "backward" means that the piece moves backward (returns) on the route (FIG. 7I).

As the symbol combination is selected, the piece position of the game element on the route is determined. The state of the determined piece position is displayed on the game display unit and a message of "Player B's turn," "Player A's piece has returned 1" is displayed. In FIG. 7J, the letter "B" is displayed at the unchanged position on the route and the letter "A" is displayed at the position returned by "1," whereby the positions of the players A and B are indicated.

FIGS. 8A to 8I show the game processing state and the game over state when an option is selected according to a symbol combination as a specific game element.

Here, the symbol combination of "7" "7" "7" is adopted as a specific game element for selecting an option. The combination for selecting the option can be set as desired.

Figure 8A:
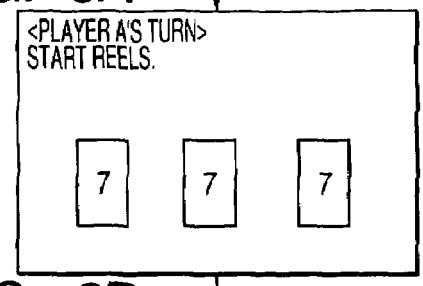
FIGS. 8A to 8I show a display example to describe the operation example of the gaming machine of the invention.
Figure 8B:
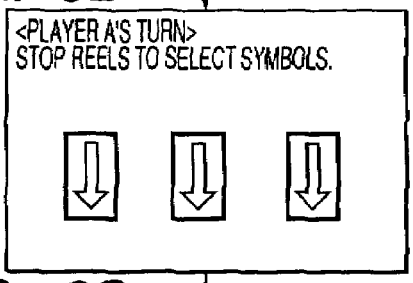
Figure 8C:
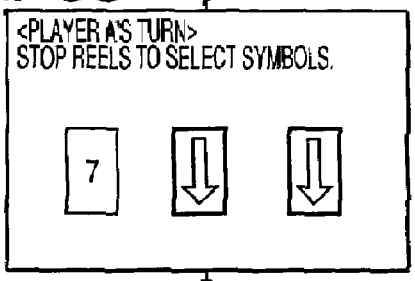

When it is the turn of the player A to play the game, the stop reels are displayed on the symbol display unit and a message of "Player A's turn," "Start reels" is displayed (FIG. 8A). The player A operates the start switch in response to the message, whereby the reels start to rotate. The rotating reels are displayed on the symbol display unit and a message of "Player A's turn," "Stop reels to select symbols" is displayed (FIG. 8B). Whenever the player operates the stop switch, the reel rotation stops and the symbols are displayed standing still on each reel. FIG. 8C shows a state in which the left reel in the figure stops and a symbol of "7" is displayed thereon.

Figure 8D:
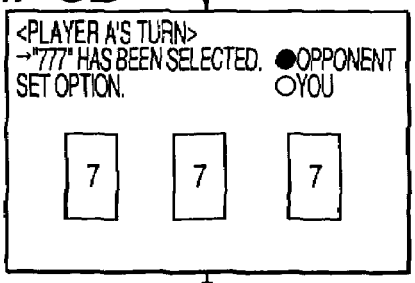

When the player stops all reels, the stopped reels are displayed on the symbol display unit. A message of "Player A's turn," ""777" has been selected. Set option." is displayed. Here, "7" "7" "7" is displayed on the symbol display unit, enabling the player to select an option through the input unit. Option selection may be made by the player or a preset option may be selected automatically (FIG. 8D).

The procedure and method for letting the player to select one from the plurality of positions may be arbitrary configured. The gaming machine 1 may be configured to let the player input the selection by use of the start switch 7 and the stop switch 8 with a user interface displayed on the display section 6. The gaming machine 1 may be configured by further providing an input device (such as an input button or a touch panel) for letting the player input the selection.

Figure 8E:
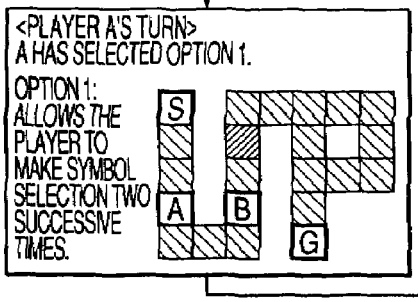

As the symbol combination is selected, a specific game element is selected and an option is selected. Here, it is assumed that the player selects option 1 through the input unit (not shown). Here, it is assumed that option 1 allows the player to make symbol selection two successive times. The function of the option can be set as desired. In FIG. 8E, a message of "Player A's turn," "Player A has selected option 1." is displayed.

Figure 8F:
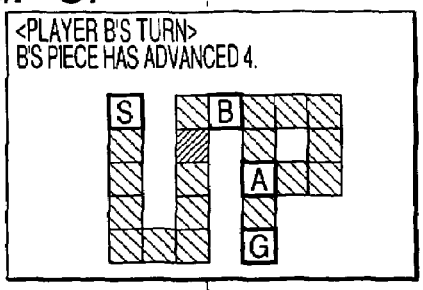

FIG. 8F shows the game processing result of B. A message of "Player B's turn," "Player B's piece has advanced 4." is displayed. The letter "A" is displayed at the unchanged position on the route and the letter "B" is displayed at the position advanced by "4," whereby the positions of the players A and B are indicated.

Figure 8G:
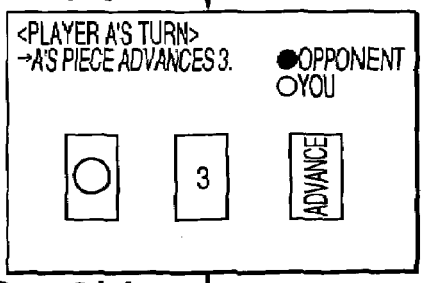
Figure 8H:
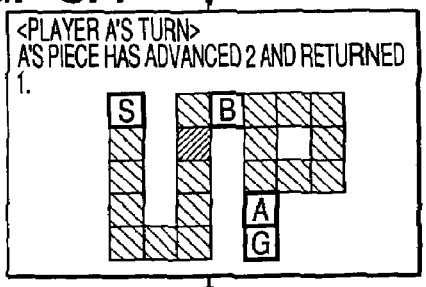

FIG. 8F shows a state in which the player A will arrive at the goal with additional 2. Here, it is assumed that the player arrives at the goal only if the piece advance number obtained by symbol selection and the remaining number to the goal match, and that the player obtains a larger advance number than the remaining number to the goal, the player returns on the route by the difference therebetween (larger advance number minus remaining number to goal). FIGS. 8G and 8H show a state in which the Player A's piece passes through the goal and returns on the route.

FIG. 8G shows the symbol selection result of A and shows that "white circle" "3" "forward" is displayed. Although the remaining number of the player A to the goal is "2," the piece advance number obtained by symbol selection is "3" and therefore the piece of the player A is placed at the position returned from the goal. In FIG. 8H, a message of "Player A's turn," "Player A's piece has advanced 2 and returned 1." is displayed. The letter "A" is displayed at the position returned "1" from the goal on the route for indicating the position of the player A.

Figure 8I:
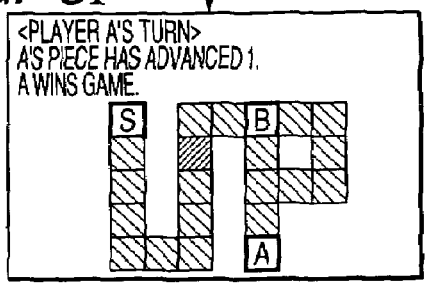

FIG. 8I shows the game over time. When the remaining number of the piece of the player A to the goal and the piece advance number obtained by symbol selection of the player A match, the piece of the player A arrives at the goal and the player A wins the game. In FIG. 8I, a message of "Player A's turn," "Player A's piece has advanced 1," "Player A wins the game." is displayed. The letter "A" is displayed at the goal on the route for indicating the position of the player A.

Figure 9A:
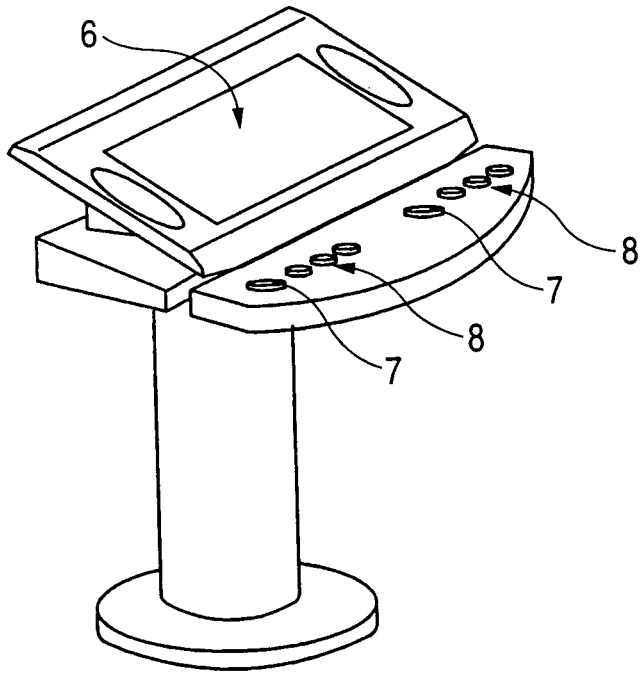
FIGS. 9A and 9B are drawings to describe the layouts of the gaming machines of the invention.
Figure 9B:
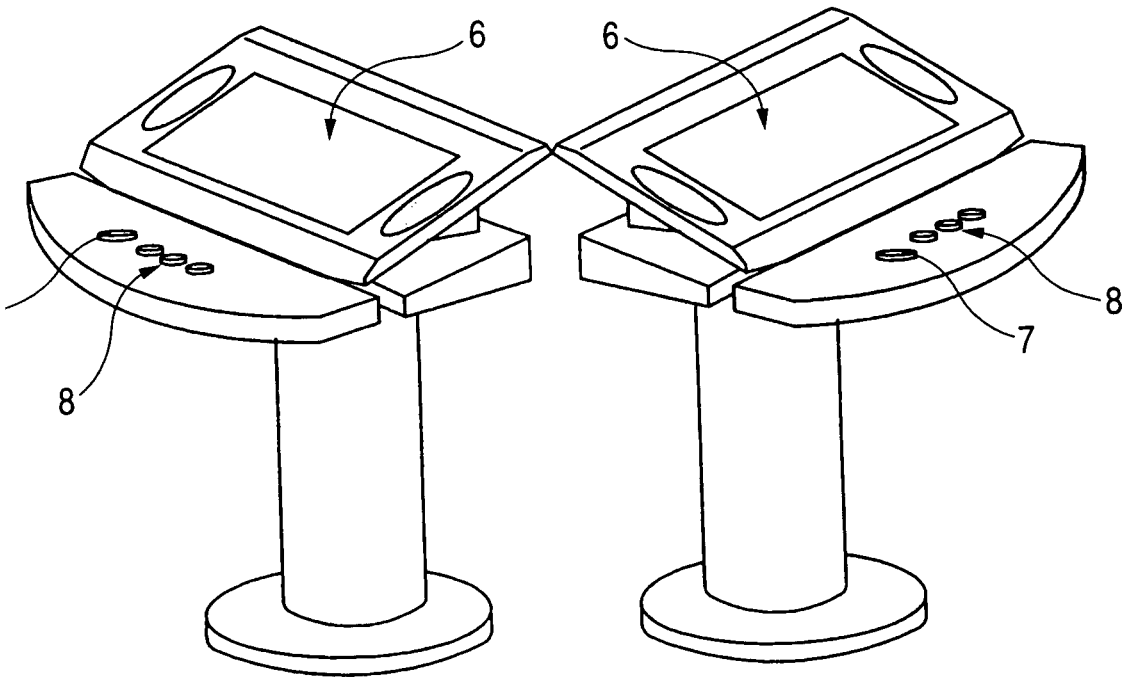

FIGS. 9A and 9B are drawings to describe the layouts of the gaming machines of the invention. FIG. 9A shows an example of the layout of one gaming machine and FIG. 9B shows an example of the layout of two or more gaming machines.

In FIG. 9A, the gaming machine includes two sets each made up of a start switch 7 and a stop section of a set of stop switches 8 for one display section 6, and two players can play a game with one gaming machine.

In FIG. 9B, the gaming machine includes one set made up of a start switch 7 and a stop section of a set of stop switches 8 for one display section 6, and a plurality of (in the figure, two) gaming machines are installed so that a plurality of players can play a game with the two or more gaming machines.

In the configuration (layout) in FIG. 9B, the display section is provided with symbol display unit and game display unit and symbol display and game display are produced on one display screen, but the game display section for producing game display can also be separated from the game display section 6 to provide separate game display unit. According to this configuration, a plurality of players and spectators can watch a game on the separately provided game display unit.

In the layouts (configurations), placement examples of the gaming machines in a gaming house, etc., are shown. However, to play a game in a battle mode, the game can also be played through a network.

Next, more detailed configuration examples of the gaming machine of the invention will be discussed. Processing performed when the selected symbol combination is inappropriate will be discussed in two different modes.

In the first mode, if the selected symbol combination is inappropriate, rotation drive of mechanical reels or circulating display of electric reels is again started and stopped for allowing the player to again select symbols. To do this, a re-selection instruction unit is provided.

In the second mode, if the selected symbol combination is inappropriate, the stop position of rotation drive of mechanical reels or circulating display of electric reels is shifted to an appropriate symbol. To do this, a next-symbol selection unit is provided.

The first mode will be discussed with a block diagram of FIG. 10 and a flowchart of FIG. 11.

Figure 10:
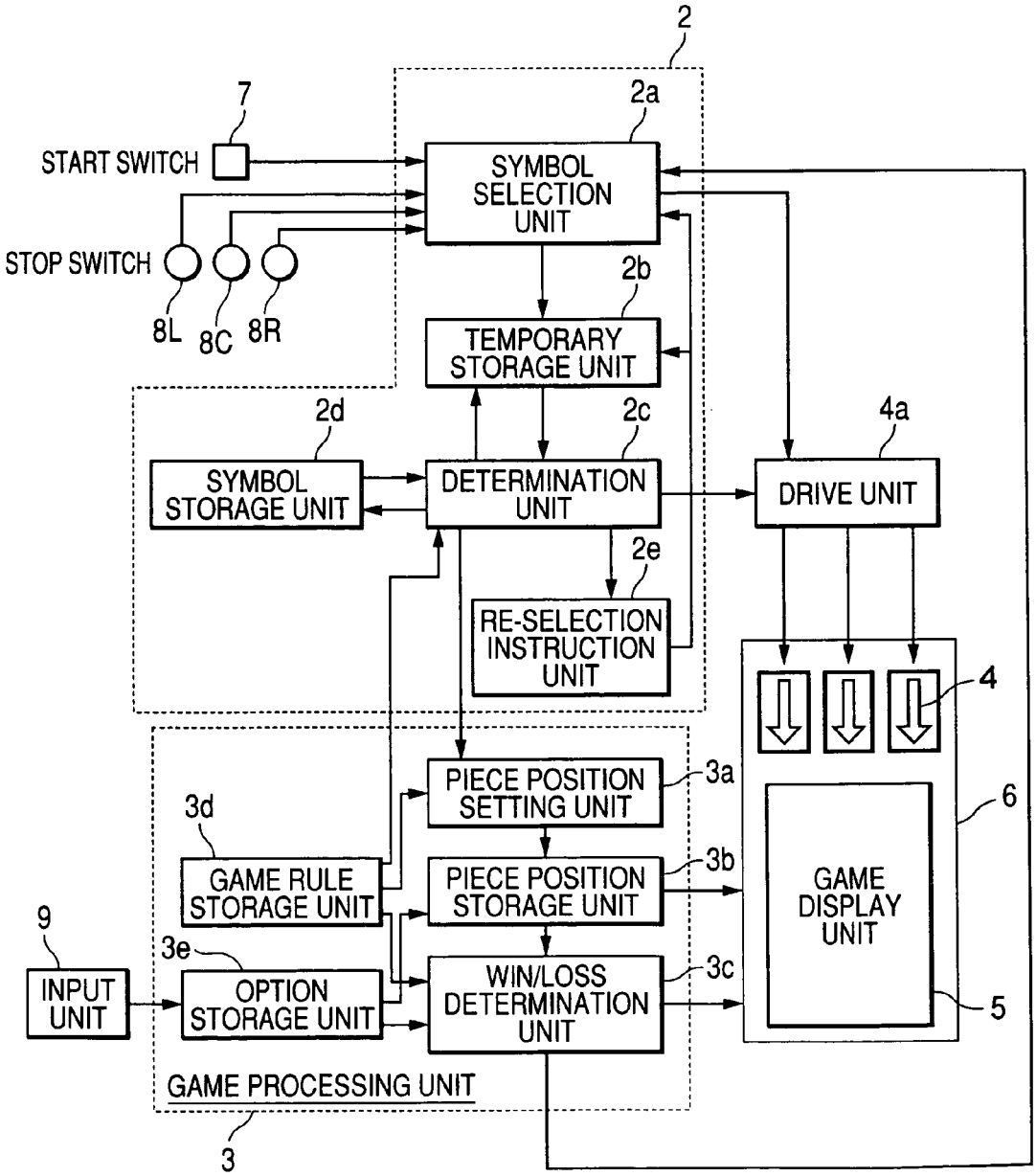
FIG. 10 is a block diagram to describe a first mode of the gaming machine of the invention.

In FIG. 10, the schematic configuration of gaming machine 1 is similar to that previously described with reference to FIG. 1. In the configuration in FIG. 10, the game element acquisition unit 2 includes a symbol selection unit 2*a*, a temporary storage unit 2*b*, a determination unit 2*c*, a symbol storage unit 2*d*, and a re-selection instruction unit 2*e*, and the game processing unit 3 includes a piece position setting unit 3*a*, a piece position storage unit 3*b*, a win/loss determination unit 3*c*, a game rule storage unit 3*d*, and an option storage unit 3*e*.

The display unit 6 includes the symbol display unit 4 and the game display unit 5. The symbol display unit 4 is driven by drive unit 4*a* and the game display unit 5 produces game display according to the game processing unit 3 and the re-selection instruction unit 2*e*.

In the game element acquisition unit 2, the symbol selection unit 2*a* serves for selecting symbols in response to operation of the player; it selects symbols based on signals from start switch 7 and stop switches 8 (8L, 8C, and 8R). The temporary storage unit 2*b* temporarily stores the symbols on all reels selected through the symbol selection unit 2*a* for each selection operation.

The determination unit 2*c* can determine whether or not the symbol combination stored in the temporary storage unit 2*b* is appropriate by comparing the selected symbol combination with the symbol combinations stored in the symbol storage unit 2*d*. For example, already selected symbol combinations and symbols whose display is inappropriate on the game progress are stored in the symbol storage unit 2*d*. A comparison is made between the selected symbol combination stored in the temporary storage unit 2*b* and each symbol combination read from the symbol storage unit 2*d*.

If the determination unit 2*c* determines that the selected symbol combination is an inappropriate symbol combination, the re-selection instruction unit 2*e* instructs the symbol selection unit 2*a* to again select the symbol at the point in time at which the symbol was determined inappropriate. For example, when a first symbol is selected, whether or not the symbol combination is appropriate cannot be determined only with the first selected symbol and thus while the reels of the symbol display unit are stopped and symbol display is produced for selecting symbols in order, when the symbol is determined inappropriate, for the symbol determined inappropriate, symbol selection needs to be executed again at the selection timing without stopping the reels of the symbol display unit.

If the determination unit 2*c* determines that the selected symbol combination is an appropriate symbol combination, the game processing unit 3 is informed of the symbol combination and the symbol combination is also stored in the symbol storage unit 2*d*.

The determination unit 2*c* also informs the drive unit 4*a* of the symbol combination for displaying the symbol combination on the symbol display unit 4. In the configuration, as the player operates the start switch, driving the drive unit 4*a* is started for starting to rotate the reels of the symbol display unit 4.

The game processing unit 3 includes the piece position setting unit 3*a* for finding the position of the piece of each player based on the symbol combination by the determination unit 2*c*, the piece position storage unit 3*b* for storing the piece position found by the piece position setting unit 3*a*, the game rule storage unit 3*d* for storing the game rule, the option storage unit 3*e* for storing an option, and the win/loss determination unit 3*c* for determining which of the players wins the game based on the piece position of the player stored in the piece position storage unit 3*b* and the game rule stored in the game rule storage unit 3*d*.

The option stored in the option storage unit 3*e* is set corresponding to a specific symbol combination and is used to set the piece position and make a win/loss determination. If the option includes a selection item, the player can select it through the input unit.

The win/loss determination unit 3*c* determines whether each player wins or loses the game based on the piece position of the player stored in the piece position storage unit 3*b*, and can also determine whether each player wins or loses the game based on the number of points (score) previously stored in the piece position storage unit 3*b*.

Figure 20:
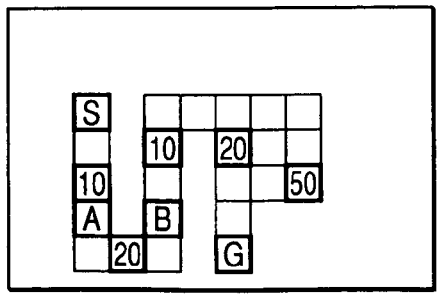
FIG. 20 shows an example of a route displayed on a screen of the liquid crystal display.

In the gaming machine 1, the events that each player obtains the point (score) may be configured arbitrarily. One example of such event may be configured as follows: In order to trigger the event, some or all of the areas on the route on which the player's pieces is to be stopped are displayed with information (such as numbers "10" and "20" as shown in FIG. 20) indicating the points to be obtained when the player's pieces stops. When the player's piece advances to (stops on) the area displayed with the information, the player obtains the number of points (such as "10 points" and "20 points") in response to the information displayed on the area.

The win/loss determination unit 3*c* determines whether or not the game is over and if the game is not over, sends a signal to the symbol selection unit 2*a*, enabling the player to perform the next selection operation. If a signal is input from the start switch or the stop switch, the symbol selection unit 2*a* does not perform selection operation until it receives an enable signal from the win/loss determination unit 3*c* to prevent the next symbol selection from being made before the win or loss is determined.

The piece position stored in the piece position storage unit 3*b* and the win/loss result are displayed on the game display unit 5.

Figure 11:
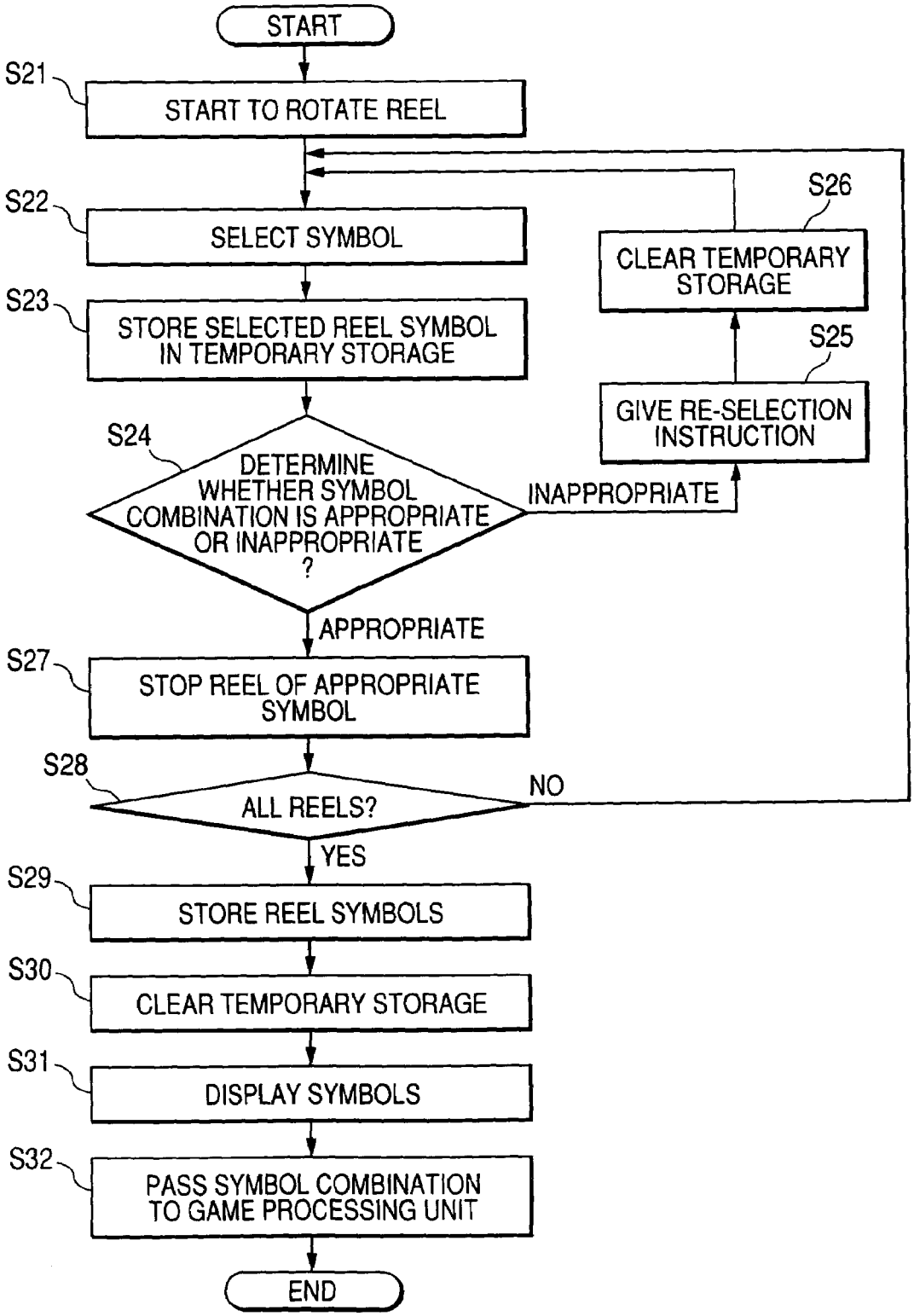
FIG. 11 is a flowchart to describe the first mode of the gaming machine of the invention.

FIG. 11 is a flowchart to describe an operation example of the game element acquisition unit.

The symbol selection unit 2*a* starts to rotate the reel based on a start signal from the start switch 7 (step S21) and upon reception of a stop signal from the stop switch 8, starts symbol selection (step S22) The selected symbol is temporarily stored (step S23).

The determination unit 2*c* determines whether or not the symbol combination stored in the temporary storage unit 2*b* is appropriate (step S24). If the symbol combination is inappropriate, the determination unit 2*c* gives a re-selection instruction to the symbol selection unit 2*a* (step S25) and clears the storage of the temporary storage unit 2*b* for the symbol at the point in time at which the symbol was determined inappropriate (step S26). If the determination unit 2*c* determines that the symbol combination is appropriate, the reel of the symbol at the point in time at which the symbol was determined appropriate (step S27).

Steps S22 to S27 are executed for all reels (step S28), the symbol combination is stored in the symbol storage unit 2*d* (step S29), and the temporary storage unit 2*b* is cleared (step S30).

The selected symbols are displayed on the symbol display unit 4 (step S31) and the selected symbol combination is passed to the game processing unit 3 (step S32).

Figure 12:
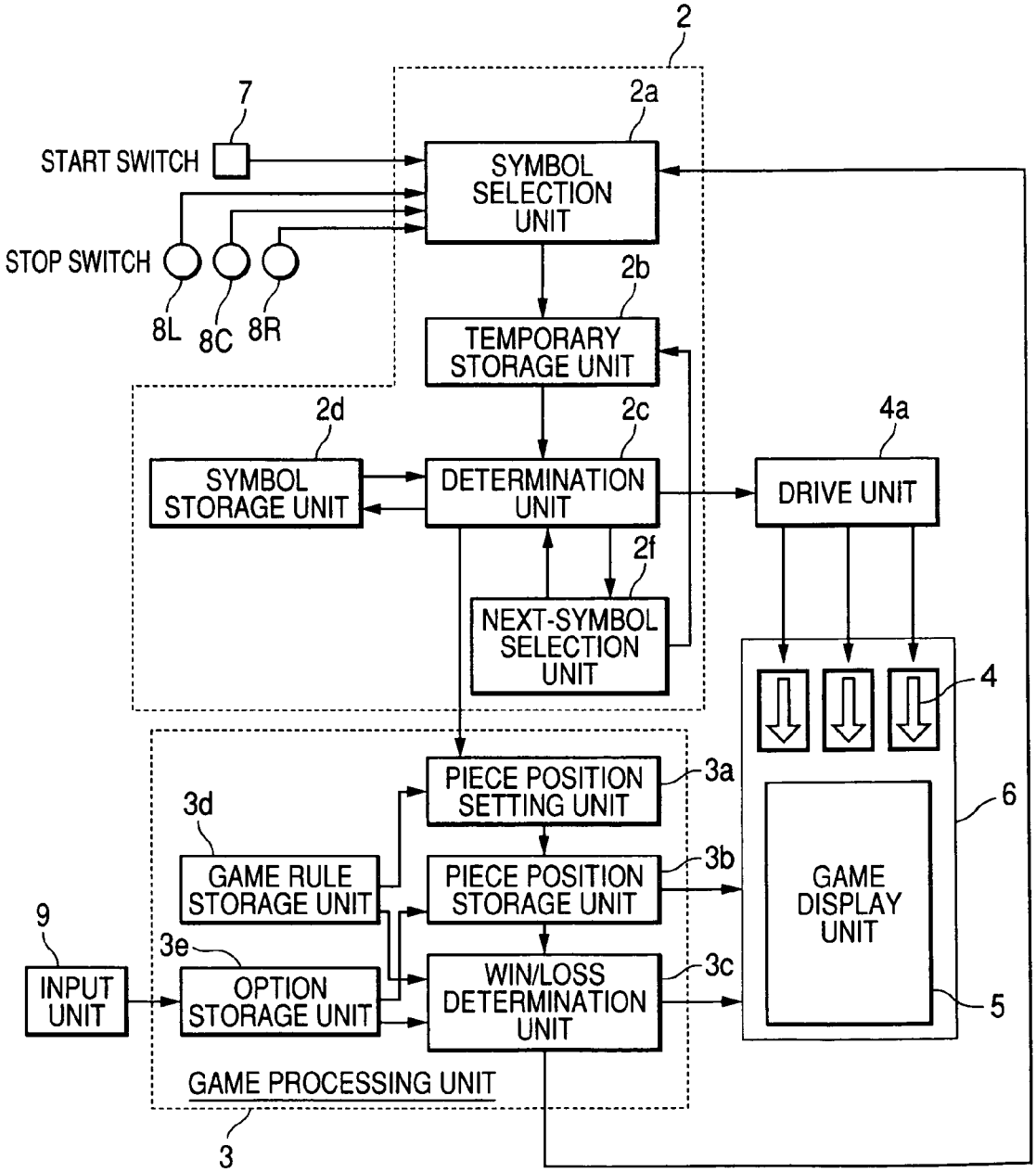
FIG. 12 is a block diagram to describe a second mode of the gaming machine of the invention.
Figure 13:
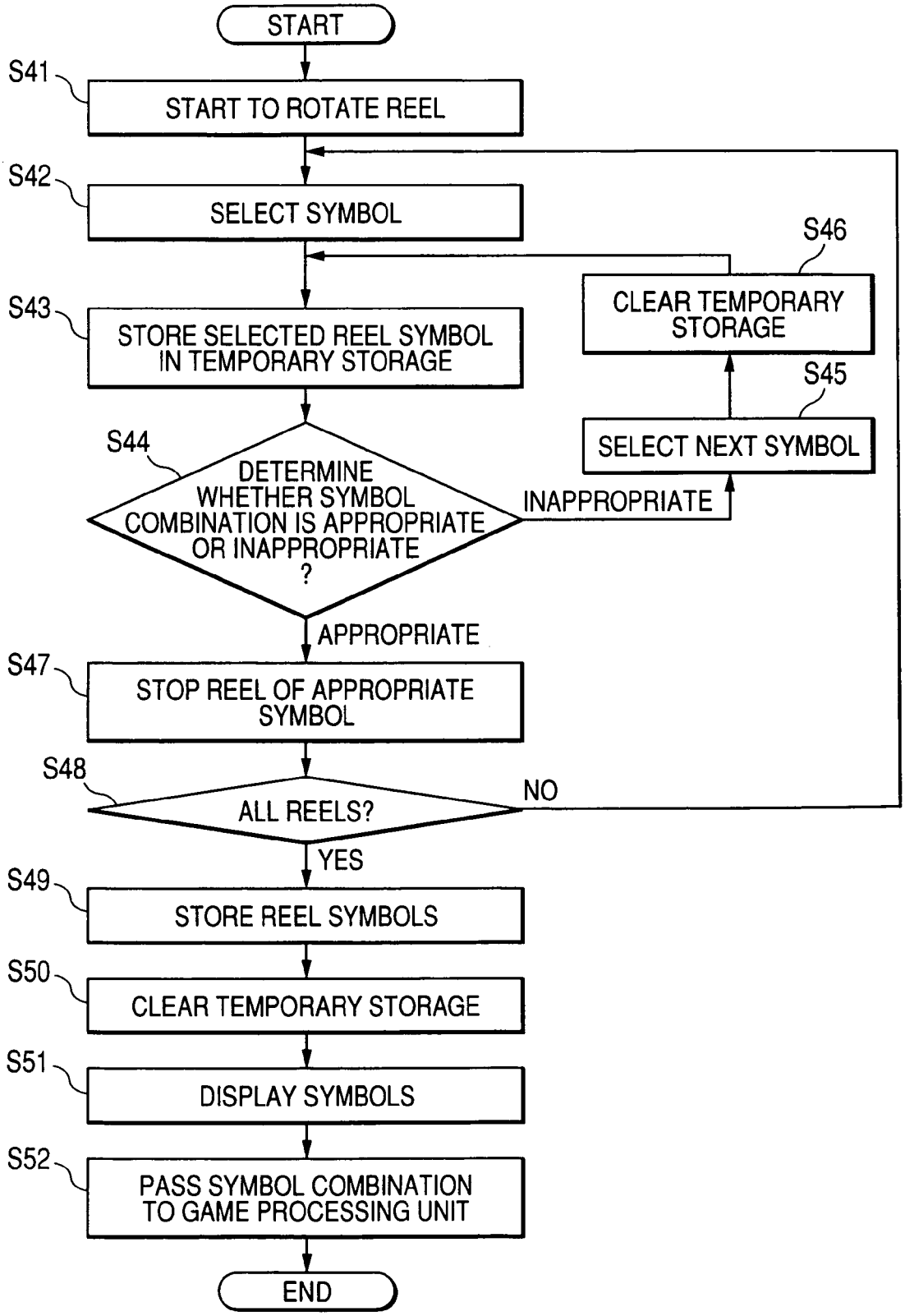
FIG. 13 is a flowchart to describe the second mode of the gaming machine of the invention.

The second mode will be discussed with a block diagram of FIG. 12 and a flowchart of FIG. 13.

The second mode differs from the first mode in processing performed when determination unit determines that the selected symbol is inappropriate, and other components are common to the second and first modes. Therefore, only the difference will be discussed and the common components will not be discussed again.

In the second mode, if the determination unit determines that the selected symbol is inappropriate, shift processing wherein next-symbol selection unit selects the symbol placed following the symbol determined inappropriate in order in the symbol row is performed; the processing is repeated until a symbol determined appropriate is obtained.

To do this, game element acquisition unit 2 includes next-symbol selection unit 2*f* in place of the re-selection instruction unit 2*e* in the first mode. The next-symbol selection unit 2*f* selects the next symbol by shift processing. The shift processing is processing of selecting the symbol placed following the symbol determined inappropriate in order in the symbols displayed on each row.

After each symbol is selected and stored according to similar steps to steps S21 to S23 described above (steps S41 to S43), upon reception of the result of determining that the selected symbol is inappropriate from determination unit 2*c* (step S44), the next-symbol selection unit 2*f* selects the next symbol arranged in the symbol row on the reel (step S45), erases the preceding symbol determined inappropriate from temporary storage unit 2*b* (step S46), and stores the newly selected symbol in the temporary storage unit 2*b* (step S47). Since there is a possibility that the newly selected symbol may be inappropriate, the processing is repeated until an appropriate symbol combination is obtained.

Figure 14:
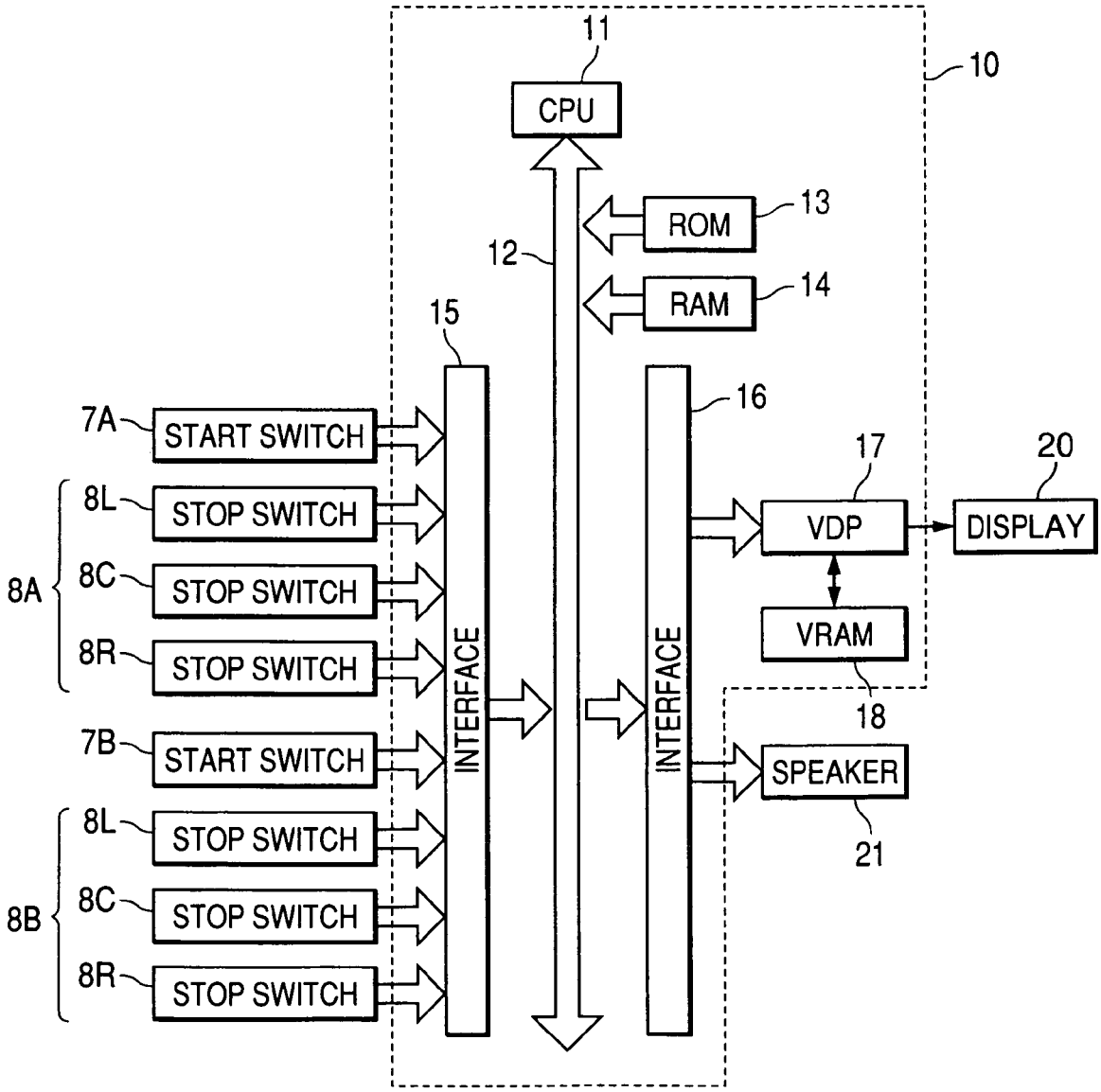
FIG. 14 is a block diagram to describe a configuration example of a control circuit for controlling the gaming machine of the invention.

FIG. 14 is a block diagram to describe a configuration example of a control circuit 10 for controlling the gaming machine.

Start switches 7*a* and 7*b* and stop switches 8*a* and 8*b* (8L, 8C, and 8R) are connected to an input/output bus 12 through an interface 15. When the player operates the start switch 7*a*, 7*b* and the stop switch 8*a*, 8*b*, the switch operation is converted into a predetermined signal through the interface 15 and the signal is sent to the input/output bus 12. A CPU 11 is connected to the input/output bus 12 via which a data signal and an address signal is input to the CPU 11.

Storages of ROM 13, RAM 14, etc., are connected to the input/output bus 12. The ROM 13 stores a control program for controlling a game of the gaming machine and also stores initial data for executing the control program, a display control program for controlling a display 20, and the like. The RAM 14 store the values of flags and variables used in the program. The variables include information of the symbols and the positions displayed on a screen, and the CPU 11 makes various determinations based on the information. The program, etc., may be stored not only in semiconductor record media of ROM, RAM, etc., but also in other record media of a magneto-optical disk, etc.

An interface 16 is connected to the input/output bus 12. Peripheral devices such as the display 20 and a speaker 21 are connected to the interface 16, and a drive signal and drive power for controlling the peripheral machines are supplied in response to the operation result of the CPU 11.

A video display processor (VDP) 17 and video RAM (VRAM) are connected between the display 20 and the interface 16. The VDP 17 generates a drive signal for driving the display 20 based on image data provided in the VRAM 18 by an image display instruction output from the CPU 11. Accordingly, symbol and game images are displayed on the display 20 of an LCD display, a CRT display, etc. The VDP 17, the VRAM 18, and the display 20 make up display unit.

Next, a third mode of the invention will be discussed. In the mode of gaming machine, route change is included as an option. When an option is selected according to a specific symbol combination, route change such as route addition or deletion is made.

Figure 15:
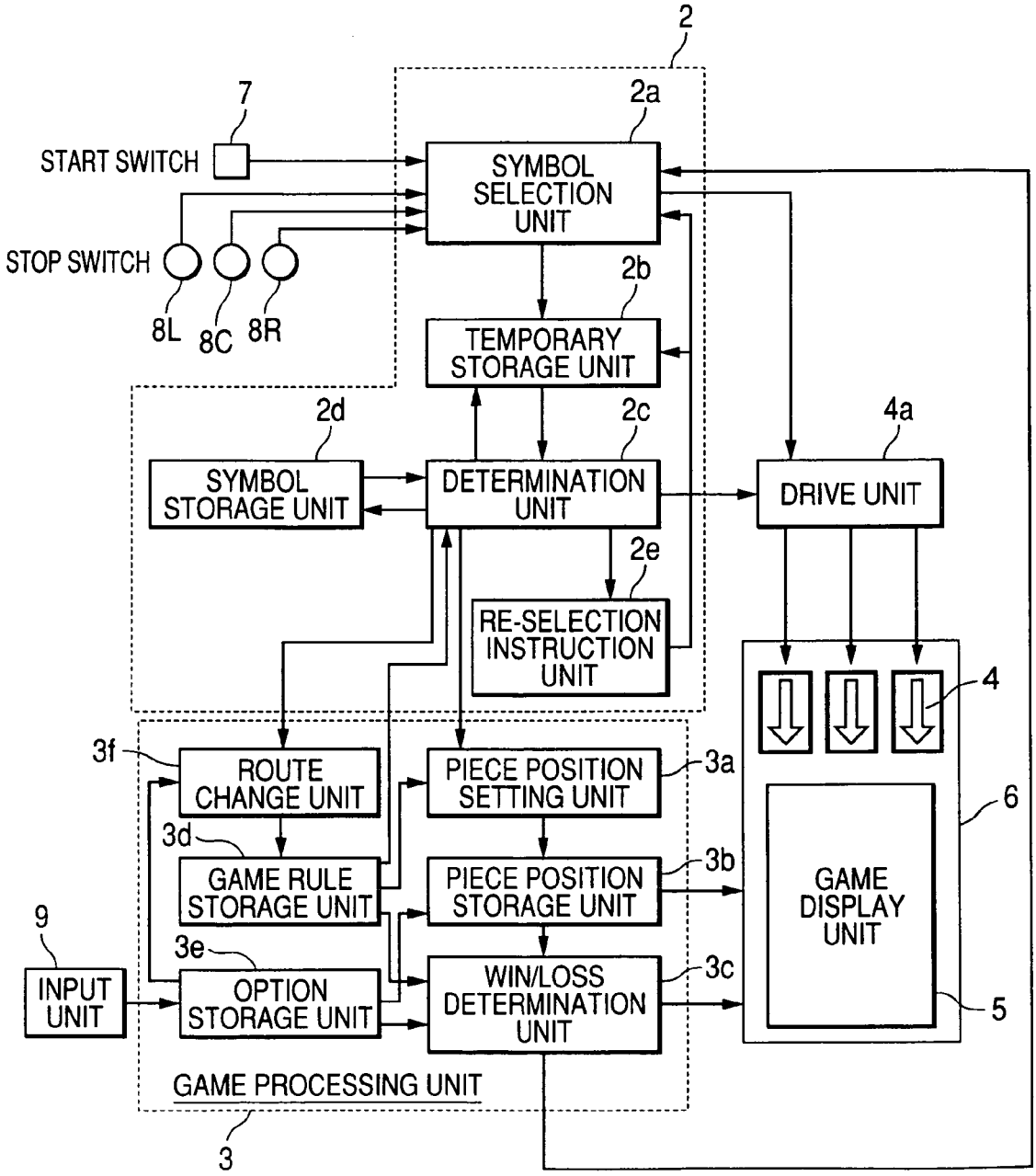
FIG. 15 is a block diagram to describe a third mode of the gaming machine of the invention.

The third mode of the invention will be discussed with a block diagram of FIG. 15 and a display example in FIGS. 16A to 16H.

The third mode differs from the first mode, the second mode in processing of symbol selection unit and determination unit and other components are common to the first, second and third modes. Therefore, only the difference will be discussed and the common components will not be discussed again.

In the third mode, game processing unit 3 includes route change unit 3*f*. When the route change unit 3*f* is informed that an option is selected from determination unit 2*c*, the route change unit 3*f* deletes an already existing route or adds a new route. Which of route deletion and route addition is selected can be determined by reading deletion route or addition route from option storage unit 3*e* based on entry through input unit 9.

Figure 16A:
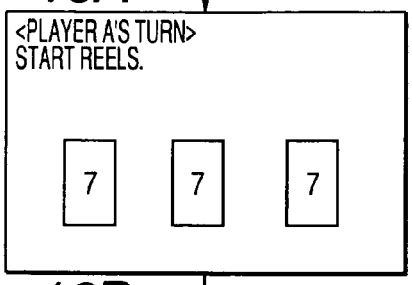
FIGS. 16A to 16H show display examples to describe an operation example of the third mode of the gaming machine of the invention.
Figure 16B:
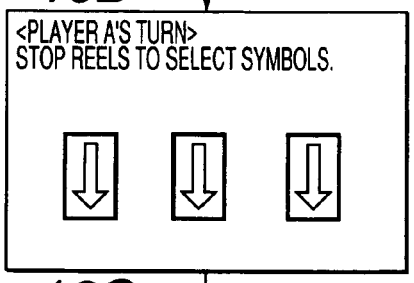
Figure 16C:
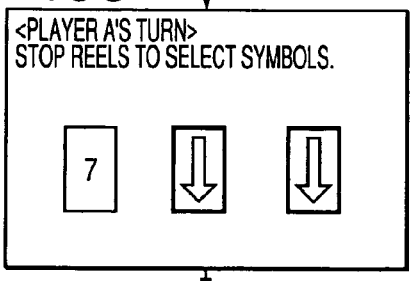

In FIG. 16, when it is the turn of player A to play the game, the stop reels are displayed on the symbol display unit and a message of "Player A's turn," "Start reels" is displayed (FIG. 16A). The player A operates the start switch in response to the message, whereby the reels start to rotate. The rotating reels are displayed on the symbol display unit and a message of "Player A's turn," "Stop reels to select symbols" is displayed (FIG. 16B). Whenever the player operates the stop switch, the reel rotation stops and the symbols are displayed standing still on each reel. FIG. 16C shows a state in which the left reel in the figure stops and a symbol of "7" is displayed thereon.

Figure 16D:
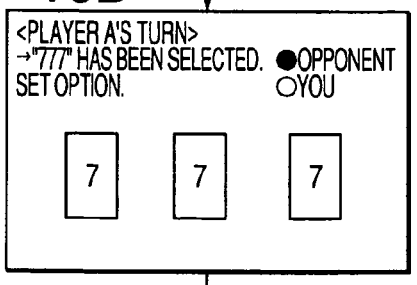

When the player stops all reels, the stopped reels are displayed on the symbol display unit. A message of "Player A's turn," "777" has been selected. Set option." is displayed. Here, "7" "7" "7" is displayed on the symbol display unit, enabling the player to select an option. The player selects an option through the input unit. Option selection may be made by the player or a preset option may be selected automatically (FIG. 16D).

Figure 16E:
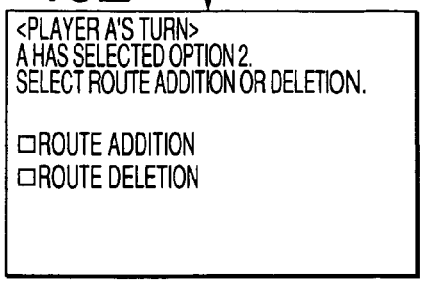

As the symbol combination is selected, a specific game element is selected and an option is selected. Here, it is assumed that the player selects option 2 through the input unit (not shown). Here, it is assumed that option 2 allows the player to add or delete route. The function of the option can be set as desired. In FIG. 16E, a message of "PlayerA's turn," "Player A has selected option 2. Select route addition or deletion." is displayed, and selection buttons of route addition and route deletion are displayed. The player selects route addition or route deletion through the input unit 9.

Figure 16F:
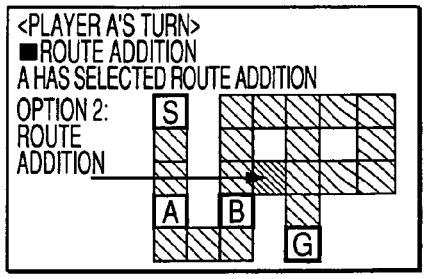

FIG. 16F shows a state in which the player selects route addition. As the player selects route addition, the added route (hatched part in the figure) is added to the route displayed by the game display unit. A message of "Player A has selected route addition" is displayed.

Figure 16G:
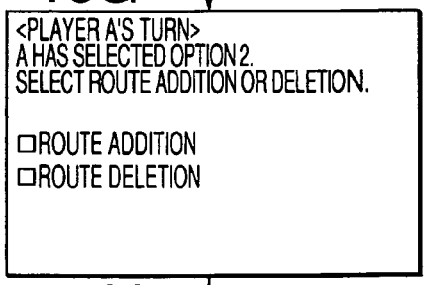
Figure 16H:
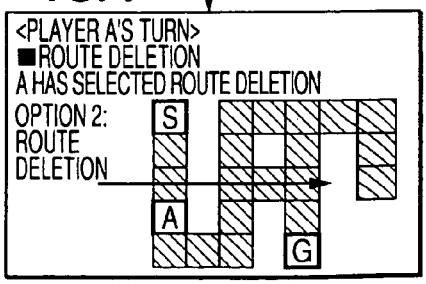

FIG. 16G shows a state in which the player selects route deletion. As the player selects route deletion, partial route is deleted from the route displayed by the game display unit. A message of "Player A has selected route deletion" is displayed.

In the gaming machine 1, the procedure and method for letting the player to select one from the plurality of options and for letting the player to select the area to be added or deleted may be arbitrary configured. The gaming machine 1 may be configured to let the player input the selection by use of the start switch 7 and the stop switch 8 with a user interface displayed on the display section 6. The gaming machine 1 may be configured by further providing an input device (such as an input button or a touch panel) for letting the player input the selection.

Hereinafter, a fourth embodiment according to the invention will be described in detail. The fourth embodiment will be described with reference to a gaming machine (slot machine) 100 shown in FIG. 17, wherein the game described in the aforementioned embodiments is provided as a bonus game that starts when the symbols are stopped in a specific arrangement that is defined to award a win for the bonus game. One example of such specific arrangement is when a specific combination of symbols is aligned on a pay line.

Figure 17:
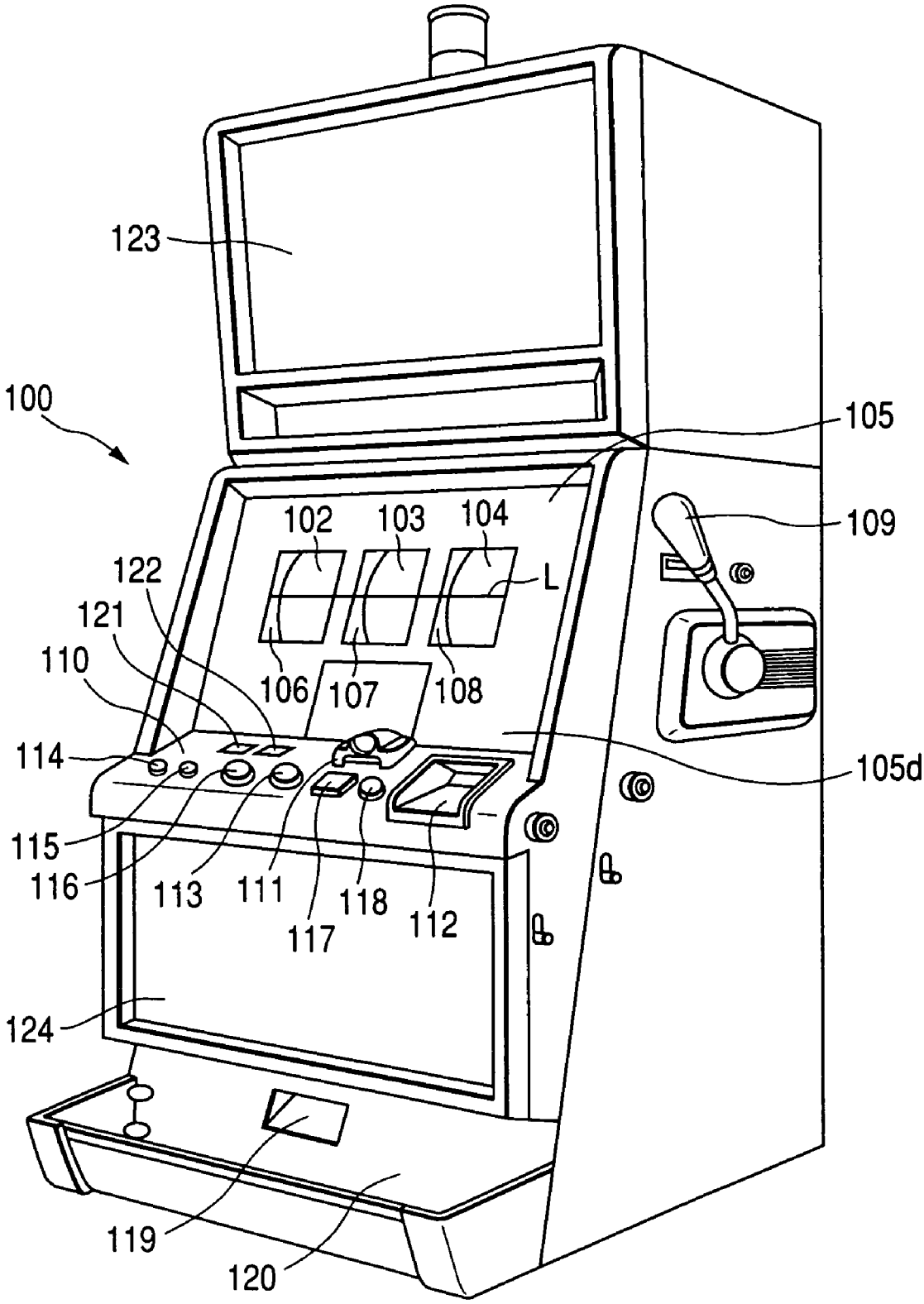
FIG. 17 is a perspective view showing a gaming machine according to a fourth embodiment.

FIG. 17 shows a slot machine as an example of the gaming machine 100. As shown in the figure, three reels of a first reel 102, a second reel 103, and a third reel 104 are provided for rotation in a cabinet in the center of the main body of the slot machine 100 as a gaming machine. Symbol columns including different types of symbols are drawn on the outer peripheral surface of each of the reels 102 to 104. The symbols are variably displayed as a player operates a handle 109 provided on a side of the cabinet in a usual gaming state in which the player inputs a game medal as a game medium and plays a game. A reel display window section 105 is placed on the fronts of the reels 102 to 104. Three symbols drawn on the outer peripheral surface of each of the reels 102 to 104 are displayed through a display window 106, 107, 108 formed in the reel display window section 105. The reel display window section 105 is formed with a pay line L defining a symbol combination, and a combination is determined by the still symbol combination displayed on the pay line L in the display windows 106 to 108. The reel display window section 105 is made of a transparent liquid crystal panel 105*d* for displaying various pieces of game information and various game effect images while the player plays a game.

A control panel 110 placed below the reel display window section 105 is provided with a medal insertion slot 11 for a player to input a medal and a bill insertion slot 112 for a player to insert a bill. The control panel 110 is also provided with a spin switch 113 for starting rotation of the reels 102 to 104 by pushbutton operation aside from operation of the handle 109 and is further provided with a change switch 114, a cash out switch 115, a bet 1 switch 116, a max bet switch 117, and a stop button 118.

The change switch 114 switches between paying out the medal gained by the player to a medal tray 120 through a payout opening 119 and reserving the medal in the machine as credit. The number of medals in credit in the machine is displayed on a number-of-reserved-medals display section 121 including seven-segment LEDs (light emitting diodes). As the player pushes the cash out switch 115, the medals in credit are paid out to the medal tray 120. As the player presses the bet 1 switch 116 once, only one of the medals in credit is bet on a game. As the player presses the max bet switch 117 once, as many medals as the maximum number that can be bet on one game are bet on the game. The stop button 118 forms stop command acceptance means for accepting from the player a stop command of the symbol row variably displayed on the liquid crystal panel 105*d* in a free game. The number of medals paid out from the payout opening 119 when a predetermined combination becomes complete on the pay line L is displayed on a number-of-pay-out-medals display section 122.

A pay table indicating how many medals are paid out for a winning game is displayed on top glass 123 above the reel display window section 105. An image of a character of the gaming machine or the like is drawn on bottom glass 124 below the reel display window section 105.

Figure 18:
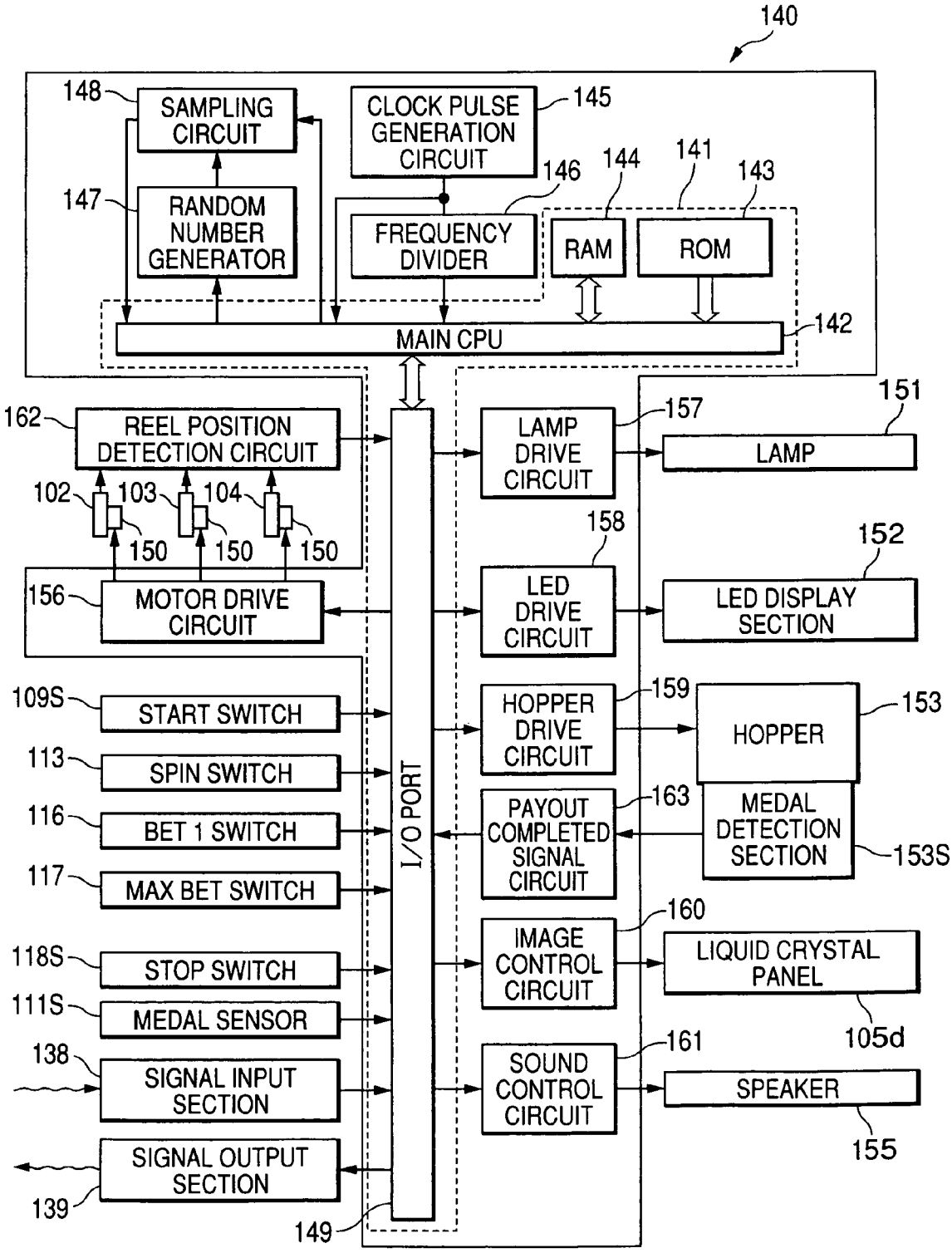
FIG. 18 is a block diagram showing a electrical circuit provided in the gaming machine.

Next, a controller for controlling the progress of a game in the slot machine 100 will be discussed. FIG. 18 is a block diagram to show the circuit configuration of a control circuit 140 for controlling the game processing operation of the slot machine 100. As shown in the figure, the control circuit 140 has a microcomputer 141 as a main component, and the microcomputer 141 is including a main CPU (central processing unit) 142 for performing control operation in accordance with a preset program and ROM (read-only memory) 143 and RAM (random access memory) 44 as storage unit. The ROM 143 stores the whole control processing procedure of the gaming machine as a sequence program, and the RAM 144 is used as a temporary storage work area when the program is executed.

Connected to the main CPU 142 are a clock pulse generation circuit 145 and a frequency divider 146 for generating a reference clock pulse, a random number generator 147 for generating a constant range of random numbers, and a sampling circuit 148 for determining one of the generated random numbers. Further, an I/O port 149 for transferring a signal to and from peripheral devices (actuators) described later is connected to the main CPU 142. In the ROM 143, the storage section is divided so as to store a combination table, a variation mode table, etc., in addition to the sequence program.

The microcomputer 141, the random number generator 147, and the sampling circuit 148 serve as a lottery unit for determining a combination by lottery; the still symbols to be displayed on the display windows 106 to 108 or the liquid crystal panel 105*d* are selected by lottery and a combination is determined by the selected symbol combination.

The main actuators whose operation is controlled by a control signal from the microcomputer 141 include stepping motors 150 for rotating the reels 102 to 104, various lamps 151, an LED display section 152 of the number-of-reserved-medals display section 121, the number-of-pay-out-medals display section 122, etc., a hopper 153 for storing medals, the liquid crystal panel 105*d*, and a speaker 155, which are driven or controlled by a motor drive circuit 156, a lamp drive circuit 157, an LED drive circuit 158, a hopper drive circuit 159, an image control circuit 160, and a sound control circuit 161 respectively. The drive circuits 156 to 159 and the control circuits 60 and 61 are connected to an output section of the main CPU 142 via the I/O port 149. The microcomputer 141 and the image control circuit 160 serve as stop control unit for defining the variation mode until the symbols selected by the lottery unit become complete on the pay line L in response to the spacing between the position of each symbol on the pay line L at the acceptance timing of the stop command operation with the stop button 18 and the position of each symbol in accordance with the combination determined by the lottery unit on the display of the liquid crystal panel 105*d* in a free game. Even if the player operates the stop button 118 at any timing, finally the symbol combination determined by the lottery unit always becomes complete on the pay line L regardless of the operation timing. In the embodiment, a signal output section 139 that serves as a communication device for transmitting a signal to other apparatus such as a server and other gaming machines is also connected to the output section of the main CPU 142 via the I/O port 149.

Main input signal generation unit for generating input signals required for the microcomputer 141 to generate control signals include: a signal input section 138 forming communication line for receiving a command signal from other apparatus connected thereto such as a server and other gaming machines; a start switch 109S for detecting operation of the handle 109; the spin switch 113; the bet 1 switch 116; the max bet switch 117; a stop switch 118S for detecting operation of the stop button 118; and a medal sensor 111S for detecting a medal input into the medal insertion slot 111. Further, a reel position detection circuit 162 for detecting the rotation positions of the reels 102 to 104 is included.

Further, the input signal generation unit includes a medal detection section 153S for counting the number of medals paid out from the hopper 153 and a payout completion signal generation circuit 163. The payout completion signal generation circuit 163 generates a signal for detecting completion of the medal payout when the actually paid-out medal count input from the medal detection section 153S reaches the number-of-award-medals data displayed on the number-of-pay-out-medals display section 122. The circuits making up the input signal generation unit are also connected to the main CPU 142 via the I/O port 149.

In the fourth embodiment, the reels 102-104 that are variably displayed are stopped when the player operates the stop switch 118S. However, the gaming machine 100 may be configured that the variable display of the reels 102-104 stop automatically based on the control process processed by the main CPU 142 regardless of the player's operation input via the stop switch 118S.

In the gaming machine 100 according to the fourth embodiment, the reels 102-104 are mechanically rotated to be variably displayed. However, the gaming machine 100 may be configured without providing the reels 102-104 that are mechanically provided and displaying video reels, instead of the reels 102-104, on the liquid crystal panel 105*d* as such similar to the embodiments described above with reference to FIG. 3.

In the fourth embodiment, the control circuit 140 serves as the game element acquisition unit 2 and the game processing unit 3 of the aforementioned embodiments.

In the gaming machine 100, the symbols arranged on the reels 102-104 are variably displayed as a player operates a handle 109 provided on a side of the cabinet in a usual gaming state in which the player inserts the game medal as game medium and plays the game.

Figure 19:
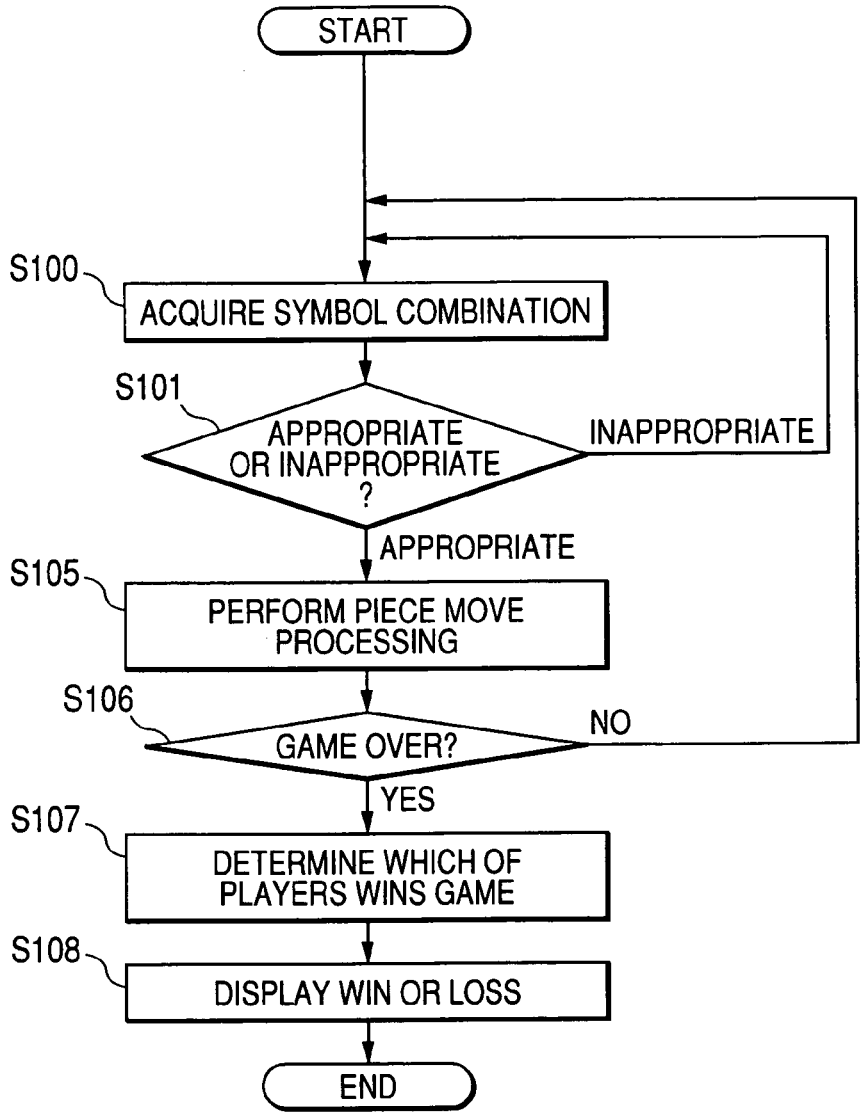
FIG. 19 is a flowchart showing an example of operation of the gaming machine.

When the symbols are stopped on the pay line L in a specific combination, a so-called bonus game starts. In the bonus game, a procedure similar to the procedure described in the aforementioned embodiments is processed by the main CPU 142, based on a procedure shown in FIG. 19, thereby to perform the bonus game similar to the game described in the aforementioned embodiments.

In the fourth embodiment, it is assumed that the bonus game is played by a single player against a computer character. In the following description of the procedure shown in FIG. 19, detailed description of the processes the same as those shown in FIG. 5 will be omitted.

As shown in FIG. 22, when the bonus game is started, the player operates the start switch to start reel rotation and then operates the stop switches to stop the rotationally displayed reels. Operating the stop switches is controlled so that the stop switches cannot work until the reel rotation speed exceeds predetermined speed, whereby ease of the stop operation at low rotation speed time can be eliminated.

When the player operates the stop switches, the displayed symbols standing still at the operation point in time are determined on the reels, whereby the symbol combination is also determined and the game elements are also determined accordingly. The game element acquisition unit acquires the game elements involved in the symbol combination (step S100).

Whether or not the symbol combination determined as the player operates the stop switches is appropriate is determined. If the symbol combination is inappropriate, a symbol combination is again acquired at step S100. The inappropriate symbol combination applies, for example, if the use of the symbol combination is improper in the game processing. To determine whether or not the symbol combination is appropriate, whether or not the selected symbol combination is a symbol combination whose use is improper in the game processing is determined (step S101).

If the selected symbol combination is appropriate, the piece is moved based on the game element corresponding to the symbol combination (step S102).

At this time, whether or not the symbol combination is a specific symbol combination is determined and the setup option is executed. For example, if play order change or route change is set as an option for the symbol combination defining a specific game element such as "7 7 7" shown in FIG. 4, the player order is changed for the same player to repeat more than once piece move operation by selecting symbols or a new route is added to the original route or a route is deleted. Where the route to be added or the route to be deleted is may be previously determined or may be set by the player through the input unit.

On the other hand, if the symbol combination is not a specific symbol combination, game processing is performed based on the game elements responsive to the symbol combination, and the player's piece or the opponent's piece is placed in a predetermined position on the route (step S105).

As the piece move processing is performed at step S105, the piece position of the player on the route changes. Whether or not the piece position is a predetermined position, such as the goal position, is determined for determining whether or not the game is substantially over (step S106).

The game over determination criterion can be set as desired. For example, the fact that one player or a predetermined number of players arrive at the goal can also be adopted as the game over determination criterion or the number of processing times of symbol selection, the game time, etc., can also be adopted as the game over determination criterion.

If the game is not over (NO at step S106), the process returns to step S100 and steps S100 to S106 are repeated according to the next player.

On the other hand, if the game is over (YES at step S106), which of the players wins the game is determined. The determination criterion for determining which of the players wins the game can be set as desired. For example, the first player arriving at the goal at step S8 can be determined a winner or the number of points (score) acquired during moving on the route by each of the players arriving at the goal can also be adopted as the determination criterion for determining which of the players wins the game (step S107). The game result (win or loss) is displayed on the game display unit (step S108).

According to the result of the bonus game (win or loss), numbers of the area in which the player's piece has forwarded from the start point, or to the amount of points obtained by the player, a predetermined amount of medals are paid out from the payout opening 119.

In the fourth embodiment, the gaming machine 100 is configured to let the player select the option when the combination of the game element (symbols) arranged on the stopped reels corresponds to a specific game element such as "7 7 7" shown in FIG. 4. However, the gaming machine 100 may be configured that the selection of the option is automatically made by the main CPU 142. In the gaming machine 100, there may also be configured that all the procedures to proceed the bonus game is automatically made by the main CPU 142.

As described above with reference to the embodiments, the gaming machine includes display unit for the player to select a symbol and display unit for displaying the game state, whereby it is made possible to apply the gaming machine to various games without being limited by display symbols and the gaming machine enables not only a single player, but also two or more players to enter a game and the application range of the gaming machine to games can be widened.

The gaming machine as described above with reference to the embodiments can be applied not only to a sugoroku game, but also to a game for the players to move a piece on a route.

As described above with reference to the embodiments, the gaming machine includes display unit for the player to select a symbol and display unit for displaying the game state, whereby it is made possible to apply the gaming machine to various games without being limited by display symbols and the gaming machine enables not only a single player, but also two or more players to enter a game and the application range of the gaming machine to games can be widened.

The player wins or loses a game according to more than one operation and game element combination obtained by each operation rather than a simple symbol combination determined by one operation, whereby the game can be provided with competition and strategy properties for improving interest.

The above described embodiments can be also applied in the mode of a gaming machine and the mode of a gaming program.

According to the invention, there is provided a gaming machine including a symbol display unit that variably displays a plurality of symbols arranged on a reel; a game element acquisition unit that selects a symbol displayed on the symbol display unit and acquires a game element based on the selected symbol; a game processing unit that performs game processing for players to compete with each other for a move of a piece based on the game element acquired in the game element acquisition unit; and a game display unit that displays the processing result of the game processing unit.

The symbol display unit is a mechanism of a display for rotating a plurality of symbols provided on each reel, thereby varying and displaying the symbols, for example, and can display a combination of symbols by using a plurality of reels. The game element acquisition unit includes a selection function of selecting the symbols displayed on the symbol display unit and a game element acquisition function of acquiring a game element based on the selected symbols.

Here, the game element is an element that configures a game and an element for progressing a game. For example, the game element is an element that indicates at least one of a movement of a piece that belongs to each of the players and an order of the players to play the game. The game element is determined in accordance with the game rule.

The game element acquisition unit determines the game element based on the selected symbol combination and the game is formed and is advanced according to the game element, whereby the game can be provided with competition and strategy properties without determining the win or loss of the game only by one displayed symbol. The symbols selected in the game element acquisition unit are displayed on the symbol display unit.

The game processing unit performs game processing for players to compete with each other for a move of a piece based on the game element acquired in the game element acquisition unit, and displays the processing result on the game display unit. The game processing based on the piece move is applied to a sugoroku game, for example, wherein the piece of each player is moved on the route and which of the players wins the game is determined based on the piece move, such as the first player arriving at the goal, the number of points (score) acquired during moving on the route, etc.

To perform the game processing, the game processing unit includes piece position setting unit for determining the piece position on a route based on the game element acquired in said game element acquisition unit; piece position storage unit for storing the piece position set in said piece position setting unit; and win/loss determination unit for determining which of the players wins the game based on a comparison between the piece position stored in the piece position storage unit and a predetermined position.

The piece position setting unit determines which position on the route the piece of each player is to be placed in based on the game element. The position on the route may be determined as the absolute position or may be determined as the relative position based on the move amount. To determine the piece position as the absolute position, the game element specifies the position on the route. To determine the piece position as the relative position, the game element specifies the move amount containing the move direction from the current position.

The piece position set by the piece position setting unit is stored in the piece position storage unit and is used to display 5 the piece position and update the piece position in the next game processing. At this time, the piece position setting unit changes the piece position stored in the piece position storage unit based on the game element.

The win/loss determination unit determines which of the players wins the game based on a comparison between the piece position stored in the piece position storage unit and a predetermined position on the route. For example, the win/loss determination unit determines which of the players wins the game based on the fact that the piece position arrives at the predetermined position on the route or the number of points (score) acquired as the piece position arrives at the predetermined position on the route.

The game processing unit of the invention includes route change unit for changing the route based on the game element acquired in the game element acquisition unit. The game processing unit moves the piece along the route changed by the route change unit.

The symbol display unit can have at least one mechanical reel for rotating with a symbol row having a plurality of symbols provided on the outer periphery of the reel or at least one electric reel for producing electric circulating display of a plurality of symbols.

The game element acquisition unit controls starting and stopping of rotation of the mechanical reel of the symbol display unit or circulating display of the electric reel of the symbol display unit. For example, the game element acquisition unit controls the gaming machine so as to start rotation of the mechanical reel or circulating display of the electric reel as a start switch is operated and stop rotation of the mechanical reel or circulating display of the electric reel as a stop switch is operated. A symbol and a game element are acquired from the stop state of the reel under the control of the game element acquisition unit.

If the selected symbol is an inappropriate symbol, symbol re-selection processing or shift processing until an appropriate symbol is selected is performed.

If the selected symbol is an inappropriate symbol, the game element acquisition unit has a first processing mode in which it includes re-selection instruction unit. If the selected symbol is an inappropriate symbol, the re-selection instruction unit again starts and stops rotation of the mechanical reel or circulating display of the electric reel for again selecting a symbol.

The game element acquisition unit has a second processing mode in which it includes next-symbol selection unit. If the selected symbol is an inappropriate symbol, the next-symbol selection unit shifts the stop position of rotation of the mechanical reel or circulating display of the electric reel to an appropriate symbol.

The symbol display unit and the game display unit are formed on a common liquid crystal display surface as liquid crystal display; in addition, the symbol display unit can also be implemented as mechanical display and the game display unit can also be implemented as liquid crystal display.

In the display mode in which the symbol display unit is implemented as mechanical display and the game display unit is implemented as liquid crystal display, the game display unit can be formed on a transmission liquid crystal display surface, the symbol display unit of the mechanical reel can be placed on the back of the transmission liquid crystal display surface, and reel of the mechanical reel can be produced through the transmission liquid crystal display surface.

To form a game in a battle mode, symbol display unit are provided in a one-to-one correspondence with players. The game element acquisition unit displays the acquired symbol on the symbol display unit provided for each player. According to the configuration, each player can select a symbol independently of other players and can know the selected symbol.

The game display unit is provided for each of the plurality of symbol display unit; in addition, one game display unit can also be provided for a plurality of symbol display unit. According to the configuration wherein the game display unit is provided for each of the plurality of symbol display unit, effect display matching the game state of each player can be produced. According to the mode, applying the gaming machine to a game mode played through a network is facilitated.

According to the configuration wherein one game display unit is provided for a plurality of symbol display unit, each player can select and display a symbol using the symbol display unit provided for the player and all players can observe one shared game display unit. Spectators other than the players can also watch a game on the shared game display unit.

According to the invention, there is provided a computer-readable program product for causing a computer to execute: displaying a varying state and a stop state of a plurality of symbols; varying the symbols and acquiring a game element from the symbol at a stop position; reading a piece position currently stored in a piece position storage unit; determining a move amount of the piece position from the acquired game element; determining a new piece position with respect to the piece position read from the piece position in accordance with the determined move amount; updating the new piece position as the current piece position to store in the piece position storage unit; determining a comparison between the piece position and a predetermined position.

According to the invention, there is provided an automatic game performing method executed in a computer comprising the steps of: displaying a varying state and a stop state of a plurality of symbols; varying the symbols and acquiring a game element from the symbol at a stop position; reading a piece position currently stored in a piece position storage unit; determining a move amount of the piece position from the acquired game element; determining a new piece position with respect to the piece position read from the piece position in accordance with the determined move amount; updating the new piece position as the current piece position to store in the piece position storage unit; determining a comparison between the piece position and a predetermined position.

The gaming program causes a computer to execute the steps, whereby a game element is acquired according to symbol selection, the piece position on the route is determined based on the acquired game element, and game processing is performed based on the piece move.

According to the invention, the application range in the game types, the number of players entering a game, etc., can be widened in the gaming machine using a symbol combination. The gaming machine can be provided with competition properties for improving interest by more than one operation and game element combination obtained by each operation.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable those skilled in the art to utilize the invention in various embodiments and with various modifications as are suited to the particular use contemplated. It is intended that the scope of the invention be defined by the claims appended hereto, and their equivalents.

What is claimed is:

1. A gaming machine comprising:

a symbol display unit that variably displays a plurality of symbols arranged on each of at least two reels, the at least two reels configured to be started by a player, the symbol display unit including the at least two reels for rotating a symbol row having a plurality of symbols provided on an outer periphery of the reel;

a game element acquisition unit that selects a combination of symbols displayed on the symbol display unit and acquires a game element based on the selected combination, the game element acquisition unit controlling starting and stopping of rotation of the at least two reels to acquire the symbols and the game element based on input from the player;

a game processing unit that performs game processing for players to compete with each other for a move of a piece based on the game element acquired in the game element acquisition unit, the game processing unit including, a piece position setting unit that determines the piece position on a route based on the game element acquired in the game element acquisition unit, the piece position setting unit changing the piece position stored in the piece position storage unit based on the game element acquired in the game element acquisition unit;

a piece position storage unit that stores the piece position set in the piece position setting unit;

a win/loss determination unit that determines which of the players wins the game based on a comparison between the piece position stored in the piece position storage unit and a predetermined position; and a route change unit that changes the route based on the game element acquired in the game element acquisition unit, said route change unit adds a new route when symbols acquired for all of the at least two reels are the same; and a game display unit that displays the processing result of the game processing unit.

2. The gaming machine as claimed in claim 1, wherein the at least two reels are provided as mechanical reels.

3. The gaming machine as claimed in claim 1, wherein the at least two reels are provided as video reels.

4. The gaming machine as claimed in claim 1, further comprising a start switch and a stop switch, wherein the game element acquisition unit controls the symbol display unit so as to start the rotation of the at least two reels when the start switch is operated by the player and to stop the rotation of the at least two reels when the stop switch is operated by the player.

5. The gaming machine as claimed in claim 1, further comprising a start switch, wherein the game element acquisition unit controls the symbol display unit so as to start the rotation of the at least two reels when the start switch is operated by the player and to automatically stop the rotation.

6. The gaming machine as claimed in claim 1, wherein the game element acquisition unit further includes a re-selection instruction unit that repeats to start and stop the rotation of at least one of the at least two reels for re-selecting the symbol when the selected combination is inappropriate for proceeding the game.

7. The gaming machine as claimed in claim 1, wherein the game element acquisition unit further includes a next-symbol selection unit that shifts a stop position of at least one of the at least two reels to an appropriate symbol when the selected combination is inappropriate for proceeding the game.

8. The gaming machine as claimed in claim 1, further comprising a liquid crystal display, wherein the symbol display unit and the game display unit displays the symbols and the processing result of the game processing unit on the liquid crystal display.

9. The gaming machine as claimed in claim 2, further comprising a liquid crystal display, wherein the game display unit displays the processing result of the game processing unit on the liquid crystal display, wherein the mechanical reels are provided behind the liquid crystal display, and wherein the liquid crystal display is configured to allow displaying the mechanical reels therethrough.

10. The gaming machine as claimed in claim 1, further comprising a plurality of the symbol display units provided respectively for each of the players, wherein the game element acquisition unit displays the symbol acquired for each of the players on the respective symbol display units.

11. The gaming machine as claimed in claim 10, further comprising a plurality of the game display unit provided respectively for each of the symbol display units.

12. The gaming machine as claimed in claim 10, wherein the game display unit is provided for more than one of the symbol display units.

13. The gaming machine as claimed in claim 1, wherein at least one computer character is included in the players, wherein the game processing unit automatically performs the operation for the computer character.

14. The gaming machine as claimed in claim 1, wherein the game element is an element that configures the game and an element for progressing the game.

15. The gaming machine as claimed in claim 14, wherein the game element indicates at least one of a move of a piece that belongs to each of the players and an order of the players to play the game.

16. The gaming machine as claimed in claim 1, wherein the game processing unit performs the game as a bonus game that starts when the symbols are stopped in a specific arrangement that is defined to award a win for the bonus game.

17. The gaming machine as claimed in claim 16, wherein the game processing unit performs the bonus game when a specific symbol combination of symbols is aligned on a pay line that defines the symbol combination.

18. The gaming machine as claimed in claim 1, wherein the game processing unit performs the game for the players to compete with each other for arrival at a goal by moving the piece along a route, the piece of each player being displayed at each position set on the route.

19. A computer-readable storage medium including computer executable instructions, wherein the instructions, when executed by a processor, cause the processor to perform a method comprising:

displaying a varying state and a stop state of a plurality of symbols on at least two reels;

starting the at least two reels based on input from a player;

acquiring a game element from a combination of the symbol of each reel at a stop position of each reel;

reading a piece position on a route currently stored in a piece position storage unit;

changing the route based on the game element acquired in the acquiring;

adding a new route when the symbol of each reel at a stop position of each of the at least two reels are the same;

determining a move amount of the piece position from the acquired game element;

determining a new piece position with respect to the piece position read from the piece position in accordance with the determined move amount;

updating the new piece position as the current piece position to store in the piece position storage unit; and determining a comparison between the piece position and a predetermined position.

20. An automatic game performing method executed in a computer comprising the steps of:

displaying a varying state and a stop state of a plurality of symbols on at least two reels;

starting the at least two reels based on input from a player;

acquiring a game element from a combination of the symbol of each reel at a stop position of each reel;

reading a piece position on a route currently stored in a piece position storage unit;

changing the route based on the game element acquired in the acquiring;

adding a new route when the symbol of each reel at a stop position of each of the at least two reels are the same;

determining a move amount of the piece position from the acquired game element;

determining a new piece position with respect to the piece position read from the piece position in accordance with the determined move amount;

updating the new piece position as the current piece position to store in the piece position storage unit; and determining a comparison between the piece position and a predetermined position.

* * * * *